US005136761A

United States Patent [19]

Sternlieb et al.

[11] Patent Number: 5,136,761

[45] Date of Patent: Aug. 11, 1992

[54] APPARATUS AND METHOD FOR HYDROENHANCING FABRIC

[75] Inventors: Herschel Sternlieb, Brunswick, Me.; Jodie M. Siegel, Somerville, Mass.; John M. Greenway, Westwood, Mass.; Zoltan Mate, Sherborn, Mass.; Frank E. Malaney, Milton, Mass.

[73] Assignee: International Paper Company, Purchase, N.Y.

[21] Appl. No.: 608,933

[22] Filed: Nov. 5, 1990

Related U.S. Application Data

[63] Continuation-in-part of Ser. No. 382,160, May 18, 1989, Pat. No. 4,967,456, and a continuation-in-part of Ser. No. 184,350, Apr. 21, 1988, abandoned, and a continuation-in-part of Ser. No. 41,542, Apr. 23, 1987, abandoned.

[51] Int. Cl.[5] ..... D04H 1/46

[52] U.S. Cl. ..... 28/104; 8/151.2; 28/167; 68/205 R; 428/225

[58] Field of Search ..... 28/104, 167; 8/151.2; 68/205 R; 428/225

[56] References Cited

U.S. PATENT DOCUMENTS

| | | | |
|---|---|---|---|
| 2,241,222 | 5/1941 | Sonnino | 26/2 |
| 3,214,819 | 11/1965 | Guerin | 28/72.2 |
| 3,422,510 | 1/1969 | Livingston et al. | 28/1 |
| 3,485,706 | 12/1969 | Evans | 161/72 |
| 3,498,874 | 3/1970 | Evans et al. | 161/109 |
| 3,542,632 | 11/1970 | Eickhoff | 161/65 |
| 3,873,255 | 3/1975 | Kalwaites | 425/83 |
| 3,906,130 | 9/1975 | Tsurumi et al. | 428/131 |
| 3,917,785 | 11/1975 | Kalwaites | 264/108 |
| 4,144,370 | 3/1979 | Boulton | 428/233 |
| 4,145,468 | 3/1979 | Mizoguchi et al. | 428/239 |
| 4,146,663 | 3/1979 | Ikeda et al. | 428/96 |
| 4,156,957 | 6/1979 | McKay | 28/159 |
| 4,190,695 | 2/1980 | Niederhauser | 428/234 |
| 4,233,349 | 11/1980 | Niederhauser | 428/92 |
| 4,251,587 | 2/1981 | Mimura et al. | 428/233 |
| 4,329,763 | 5/1982 | Alexander et al. | 28/104 |
| 4,426,421 | 1/1984 | Nakamae et al. | 428/234 |
| 4,497,095 | 2/1985 | Minemura et al. | 26/2 R |
| 4,499,637 | 2/1985 | Greenway | 26/2 R |
| 4,612,237 | 9/1986 | Frankenburg | 428/219 |
| 4,695,500 | 9/1987 | Dyer et al. | 428/134 |
| 4,808,467 | 2/1989 | Suskind et al. | 428/284 |
| 5,037,692 | 8/1991 | Miyazaki et al. | 428/252 |
| 5,047,276 | 9/1991 | Chomarat et al. | 428/110 |

FOREIGN PATENT DOCUMENTS

| | | |
|---|---|---|
| 287821 | 9/1964 | Australia . |
| 739652 | 8/1966 | Canada . |
| 0177277 | 9/1985 | European Pat. Off. . |
| 7410272 | 3/1974 | France . |
| 61-55253 | 3/1986 | Japan . |

*Primary Examiner*—Philip R. Coe
*Attorney, Agent, or Firm*—Walt Thomas Zielinski

[57] ABSTRACT

An apparatus 10 and related process for enhancement of woven and knit fabrics through use of dynamic fluids which entangle and bloom fabric yarns. A two stage enhancement process is employed in which top and bottom sides of the fabric are respectively supported on members 22, 34 and impacted with a fluid curtain including high pressure jet streams. Controlled process energies and use of support members 22, 34 having open areas 26, 36 which are aligned in offset relation to the process line produces fabrics having a uniform finish and improved characteristics including, edge fray, drape, stability, abrasion resistance, fabric weight and thickness.

26 Claims, 22 Drawing Sheets

WARP

FILL

APPARATUS AND METHOD FOR HYDROENHANCING FABRIC

CROSS REFERENCE TO RELATED APPLICATIONS

This application is a continuation-in-part of U.S. Ser. No. 07/382,160, filed May 18, 1989, now U.S. Pat No. 4,967,456, which was in turn a continuation-in-part of U.S. Ser. No. 07/184,350, filed Apr. 21, 1988, now abandoned, which was in turn a continution-in-part of U.S. Ser. No. 07/041,542, filed Apr. 23, 1987, now abandoned.

FIELD OF INVENTION

This invention generally relates to a textile finishing process for upgrading the quality of woven and knit fabrics. More particularly, it is concerned with a hydroentangling process which enhances woven and knit fabrics through use of dynamic fluid jets to entangle and cause fabric yarns to bloom. Fabrics produced by the method of the invention have enhanced surface finish and durability and improved characteristics such as cover, abrasion resistance, drape, stability as well as reduced air permeability, wrinkle recovery, absorption, adsorption, shrink resistance, seam slippage, and edge fray.

BACKGROUND ART

The quality of a woven or knit fabric can be measured by various properties, such as, the yarn count, thread count, abrasion resistance, cover, weight, yarn bulk, yarn bloom, torque resistance, wrinkle recovery, drape and hand.

Yarn count is the numerical designation given to indicate yarn size and is the relationship of length to weight.

Thread count in woven or knit fabrics, respectively, defines the number ends and picks, and wales and courses per inch of fabric. For example, the count of cloth is indicated by enumerating first the number of warp ends per inch, then the number of filling picks per inch. Thus, 68×72 defines a fabric having 68 warp ends and 72 filling picks per inch.

Abrasion resistance is the ability of a fabric to withstand loss of appearance, utility, pile or surface through destructive action of surface wear and rubbing.

Absorption is the process of gases or liquids being taken up into the pores of a fiber, yarn, or fabric.

Adsorption is the attraction of gases, liquids, or solids to surface areas of textile fibers, yarns, fabrics or any material.

Cover is the degree to which underlying structure in a fabric is concealed by surface material. A measure of cover is provided by fabric air permeability, that is, the ease with which air passes through the fabric. Permeability measures fundamental fabric qualities and characteristics such as filtration and cover.

Yarn bloom is a measure of the opening and spread of fibers in yarn.

Fabric weight is measured in weight per unit area, for example, the number of ounces per square yard.

Torque of fabric refers to that characteristic which tends to make it turn on itself as a result of twisting. It is desirable to remove or diminish torque in fabrics. For example, fabrics used in vertical blinds should have no torque, since such torque will make the fabric twist when hanging in a strip.

Wrinkle recovery is the property of a fabric which enables it to recover from folding deformations.

Fabric surface durability is the resistance of a material to loss of physical properties or appearance as result of wear or dynamic operation.

Hand refers to tactile fabric properties such as softness and drapability.

It is known in the prior art to employ hydroentangling processes in the production of nonwoven materials. In conventional hydroentangling processes, webs of nonwoven fibers are treated with high pressure fluids while supported on apertured patterning screens. Typically, the patterning screen is provided on a drum or continuous planar conveyor which traverses pressurized fluid jets to entangle the web into cohesive ordered fiber groups and configurations corresponding to open areas in the screen. Entanglement is effected by action of the fluid jets which cause fibers in the web to migrate to open areas in the screen, entangle and intertwine.

Prior art hydroentangling processes for producing patterned nonwoven fabrics are represented by U.S. Pat. Nos. 3,485,706 and 3,498,874, respectively, to Evans and Evans et al., and U.S. Pat. Nos. 3,873,255 and 3,917,785 to Kalwaites.

Hydroentangling technology has also been employed by the art to enhance woven and knit fabrics. In such applications warp and pick fibers in fabrics are hydroentangled at crossover points to effect enhancement in fabric cover. However, conventional processes have not proved entirely satisfactory in yielding uniform fabric enhancement. The art has also failed to develop apparatus and process line technology which achieves production line efficiencies.

Australian Patent Specification 287821 to Bunting et al. is representative of the state of the art. Bunting impacts high speed columnar fluid streams on fabrics supported on course porous members. Preferred parameters employed in the Bunting process, described in the Specification Example Nos. XV–XVII, include 20 and 30 mesh support screens, fluid pressure of 1500 psi, and jet orifices having 0.007 inch diameters on 0.050 inch centers. Fabrics are processed employing multiple hydroentangling passes in which the fabric is reoriented on a bias direction with respect to the process direction in order to effect uniform entanglement. Data set forth in the Examples evidences a modest enhancement in fabric cover and stability.

Another approach of art is represented by European Patent Application 0 177 277 to Willbanks which is directed to hydropatterning technology. Willbanks impinges high velocity fluids onto woven, knitted and bonded fabrics for decorative effects. Patterning is effected by redistributing yarn tension within the fabric—yarns are selectively compacted, loosened and opened—to impart relief structure to the fabric.

Fabric enhancement of limited extent is obtained in Willbanks as a secondary product of the patterning process. However, Willbanks fails to suggest or teach a hydroentangling process that can be employed to uniformly enhance fabric characteristics. See Willbanks Example 4, page 40.

There is a need in the art for an improved woven textile hydroenhancing process which is commercially viable. It will be appreciated that fabric enhancement offers aesthetic and functional advantages which have application in a wide diversity of fabrics. Hydroenhancement improves fabric cover through dynamic fluid entanglement and bulking of fabric yarns for improved fabric stability. These results are advantageously obtained without requirement of conventional fabric finishing processes.

The art also requires apparatus of uncomplex design for hydroenhancing textile materials. Commercial production requires apparatus for continuous fabric hydroenhancing and inline drying of such fabrics under controlled conditions to yield fabrics of uniform specifications.

Accordingly, it is a broad object of the invention to provide an improved textile hydroenhancing process and related apparatus for production of a variety of novel woven and knit fabrics having improved characteristics which advance the art.

A more specific object of the invention is to provide a hydroenhancing process for enhancement of fabrics made of spun and spun/filament yarn.

Another object of the invention is to provide a hydroenhancing process having application for the fabrication of novel composite and layered fabrics.

A further object of the invention is to provide a hydroenhancing production line apparatus which is less complex and improved over the prior art.

DISCLOSURE OF THE INVENTION

In the present invention, these purposes, as well as others which will be apparent, are achieved generally by providing an apparatus and a related method for hydroenhancing woven and knit fabrics through dynamic fluid action. A hydroenhancing module is employed in the invention in which the fabric is supported on a member and impacted with a fluid curtain under controlled process energies. Enhancement of the fabric is effected by entanglement and intertwining of yarn fibers at cross-over points in the fabric weave or knit. Fabrics enhanced in accordance with the invention have a uniform finish and improved characteristics, such as, edge fray, drape, stability, wrinkle recovery, abrasion resistance, fabric weight and thickness.

According to the preferred method of the invention, the woven or knit fabric is advanced on a process line through a weft straightener to two in-line fluid modules for first and second stage fabric enhancement. Top and bottom sides of the fabric are respectively supported on members in the modules and impacted by fluid curtains to impart a uniform finish to the fabric. Preferred support members are fluid pervious, include open areas of approximately 25%, and have fine mesh patterns which permit fluid passage without imparting a patterned effect to the fabric. It is a feature of the invention to employ support members in the modules which include fine mesh patterned screens which are arranged in offset relation to one another with respect to the process line. This offset orientation limits fluid streaks and eliminates reed marking in processed fabrics.

First and second stage enhancement is preferably effected by columnar fluid jets which impact the fabric at pressures within the range of 200 to 3000 psi and impart a total energy to the fabric of approximately 0.10 to 2.0 hp-hr/lb.

Following enhancement, the fabric is advanced to a tenter frame which dries the fabric to a specified width under tension to produce a uniform fabric finish.

Advantage in the invention apparatus is obtained by provision of a continuous process line of uncomplex design. The first and second enhancement stations include a plurality of cross-directionally ("CD") aligned and spaced manifolds. Columnar jet nozzles having orifice diameters of approximately 0.005 inches with center-to-center spacings of approximately 0.017 inches are mounted approximately 0.5 inches from the screens. At the process energies of the invention, this spacing arrangement provides a curtain of fluid which yields a uniform fabric enhancement. Use of fluid pervious support members which are oriented in offset relation, preferably 45°, effectively limits jet streaks and eliminates reed markings in processed fabrics.

Optimum fabric enhancement results are obtained in fabrics woven or knit of yarns including fibers with deniers and staple lengths in the range of 0.5 to 6.0, and 0.5 to 5 inches, respectively, and yarn counts in the range of 0.5 s to 50 s. Preferred yarn spinning systems of the invention fabrics include cotton spun, wrap spun, wool spun and friction spun.

Other objects, features and advantages of the present invention will be apparent when the detailed description of the preferred embodiments of the invention are considered in conjunction with the drawings which should be construed in an illustrative and not limiting sense as follows:

BEST MODE OF CARRYING OUT THE INVENTION

Figure 1:
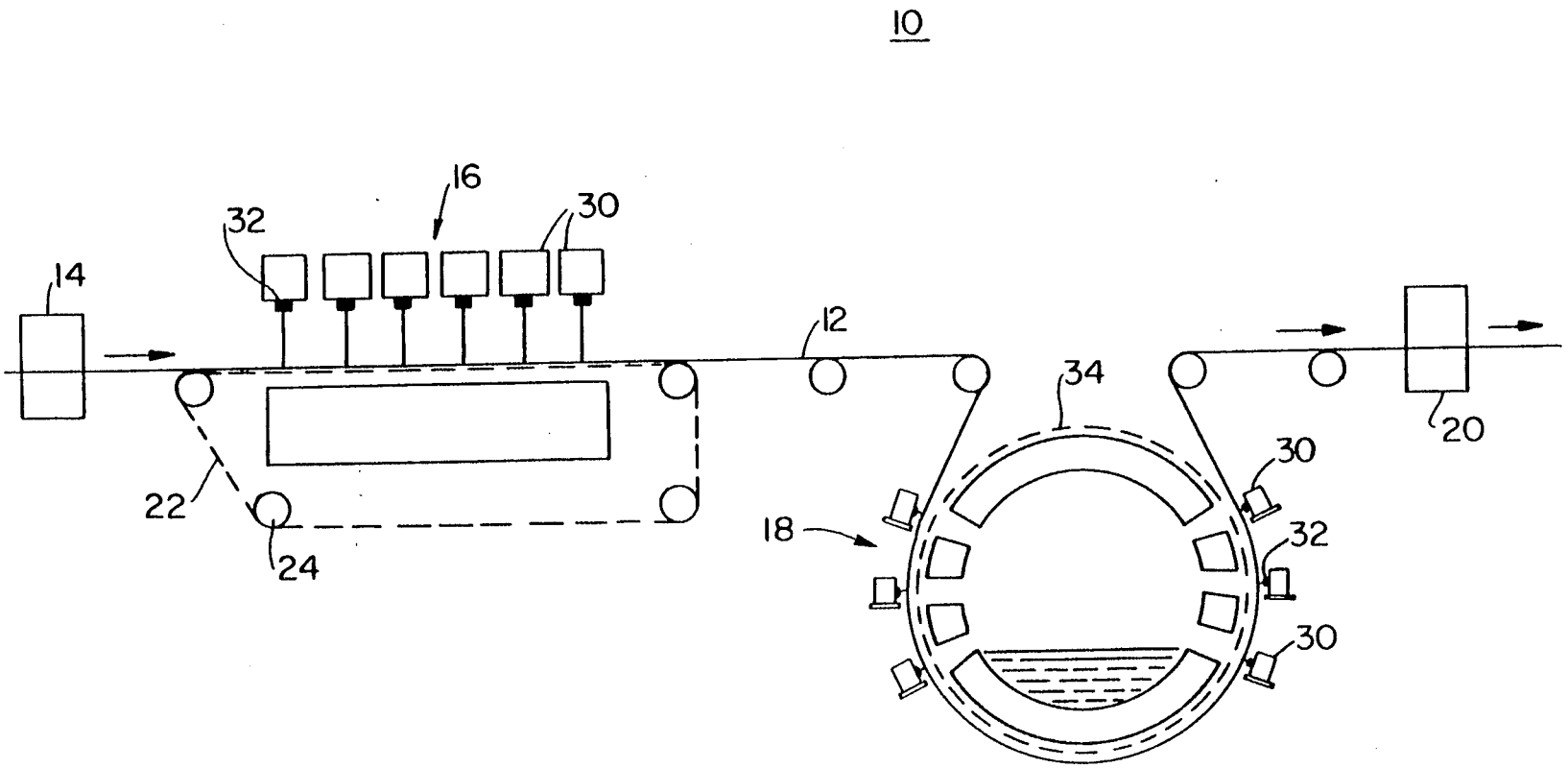
FIG. 1 is a schematic view of a production line including a weft straightener, flat and drum hydroenhancing modules, and tenter frame, for the hydroenhancement of woven and knit fabrics in accordance with the invention.

With further reference to the drawings, FIG. 1 illustrates a preferred embodiment of a production line of the invention, generally designated 10, for hydroenhancement of a fabric 12 including spun and/or spun/-filament yarns. The line includes a conventional weft straightener 14, flat and drum enhancing modules 16, 18, and a tenter frame 20.

Modules 16, 18 effect two sided enhancement of the fabric through fluid entanglement and bulking of fabric yarns. Such entanglement is imparted to the fabric in areas of yarn crossover or intersection. Control of process energies and provision of a uniform curtain of fluid produces fabrics having a uniform finish and improved characteristics including, edge fray, torque, wrinkle recovery, cupping, drape, stability, abrasion resistance, fabric weight and thickness.

METHOD AND MECHANISM OF THE ENHANCING MODULES

Fabric is advanced through the weft straightener 14 which aligns the fabric weft prior to processing in enhancement modules 16, 18. Following hydroenhancement, the fabric is advanced to the tenter frame 20, which is of conventional design, where it is dried under tension to produce a uniform fabric of specified width.

Module 16 includes a first support member 22 which is supported on an endless conveyor means including rollers 24 and drive means (not shown) for rotation of the rollers. Preferred line speeds for the conveyor are in the range of 10 to 500 ft/min. Line speeds are adjusted in accordance with process energy requirements which vary as a function of fabric type and weight.

Figure 2A:
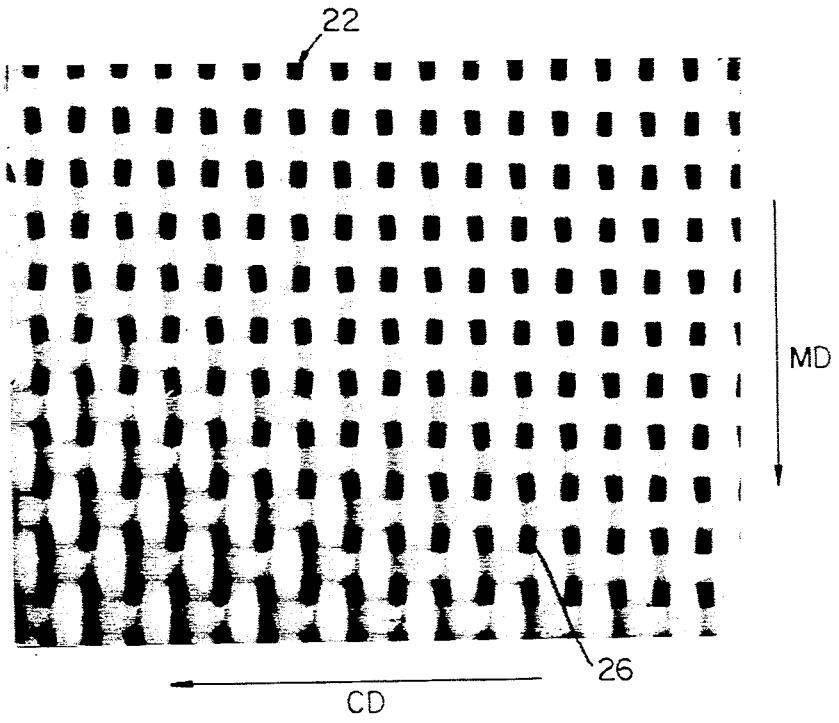
FIGS. 2A and B are photographs at 10X magnification of 36×29 90° and 40×40 45° mesh plain weave support members, respectively, employed in the flat and drum enhancing modules of FIG. 1.

Support member 22, which preferably has a flat configuration, includes closely spaced fluid pervious open areas 26. A preferred support member 22, shown in FIG. 2A, is a 36×29 90° mesh plain weave having a 23.7% open area, fabricated of polyester warp and shute round wire. Support member 22 is a tight seamless weave which is not subject to angular displacement or snag. Specifications for the screen, which is manufactured by Albany International, Appleton Wire Division, P.O. Box 1939, Appleton, Wis. 54913 are set forth in Table I.

TABLE I

| | Support Screen Specifications | |
|---|---|---|
| Property | 36 × 29 90° flat mesh | 40 × 40 45° drum mesh |
| Wire | polyester | stainless steel |
| Warp wire | .0157 | 0.010 |
| Shute wire | .0157 | 0.010 |
| Weave type | plain | plain |
| Open area | 23.7% | 36% |

Module 16 also includes an arrangement of parallel and spaced manifolds 30 oriented in a cross-direction ("CD") relative to movement of the fabric 12. The manifolds which are spaced approximately 8 inches apart each include a plurality of closely aligned and spaced columnar jet orifices 32 which are spaced approximately 0.5 inches from the support member 22.

The jet orifices have diameters and center-to-center spacings in the range of 0.005 to 0.010 inches and 0.017 to 0.034 inches, respectively, and are designed to impact the fabric with fluid pressures in the range of 200 to 3000 psi. Preferred orifices have diameters of approximately 0.005 inches with center-to-center spacings of approximately 0.017 inches.

This arrangement of fluid jets provides a curtain of fluid entangling streams which yield optimum enhancement in the fabric. Energy input to the fabric is cumulative along the line and preferably set at approximately the same level in modules 16, 18 (two stage system) to impart uniform enhancement to top and bottom surfaces of the fabric. Effective first stage enhancement of fabric yarn is achieved at an energy output of at least 0.05 hp-hr/lb and preferably in the range of 0.1 to 2.0 hp-hr/lb.

Figure 2B:
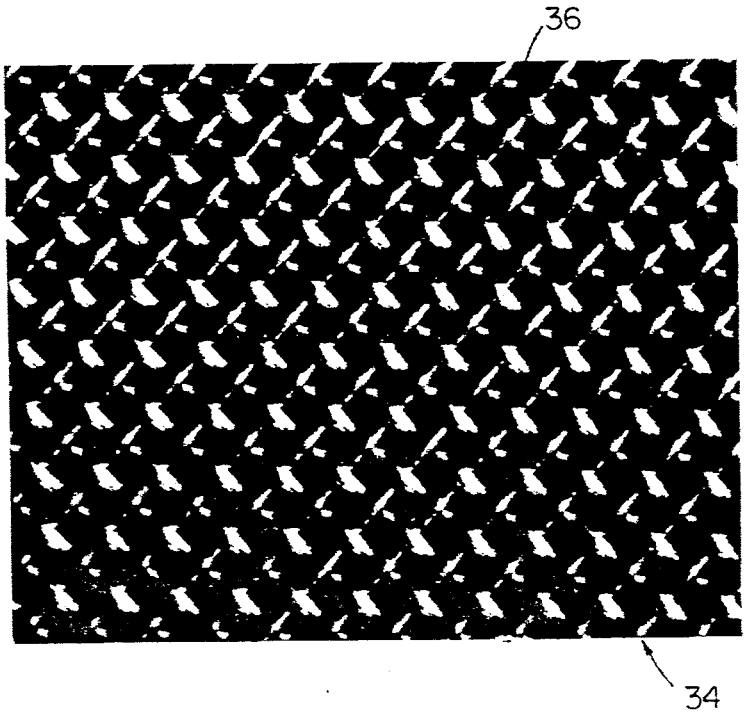

Following the first stage enhancement, the fabric is advanced to module 18 which enhances the other side of the fabric. Module 18 includes a second support member 34 of cylindrical configuration which is supported on a drum. The member 34 includes closely spaced fluid pervious open areas 36 which comprise approximately 36% of the screen area. A preferred support member 34, shown in FIG. 2B, is a 40×40 45° mesh stainless steel screen, manufactured by Appleton Wire, having the specifications set forth in Table I.

Module 18 functions in the same manner as the planar module 16. Manifolds 30 and jet orifices 32 are provided which have substantially the same specifications as in the first stage enhancement module. Fluid energy to the fabric of at least 0.5 hp-hr/lb and preferably in the range of 0.1 to 2.0 hp-hr/lb effects second stage enhancement.

Figure 3A:
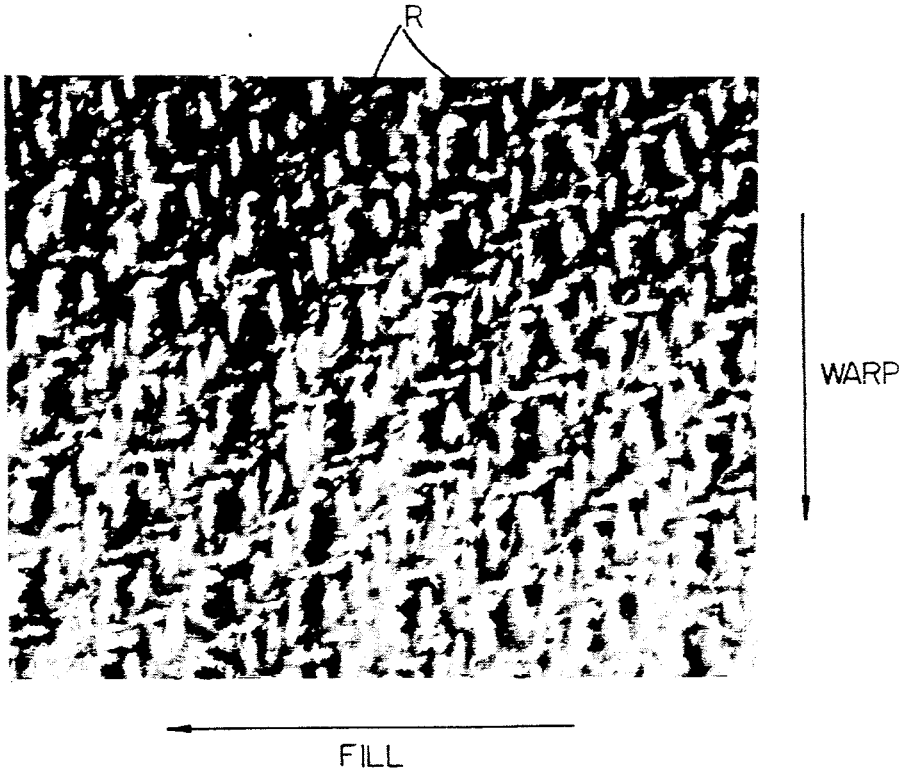
FIGS. 3A and B are photomicrographs at 10X magnification of a fine polyester woven fabric before and after hydroenhancement in accordance with the invention.
Figure 3B:
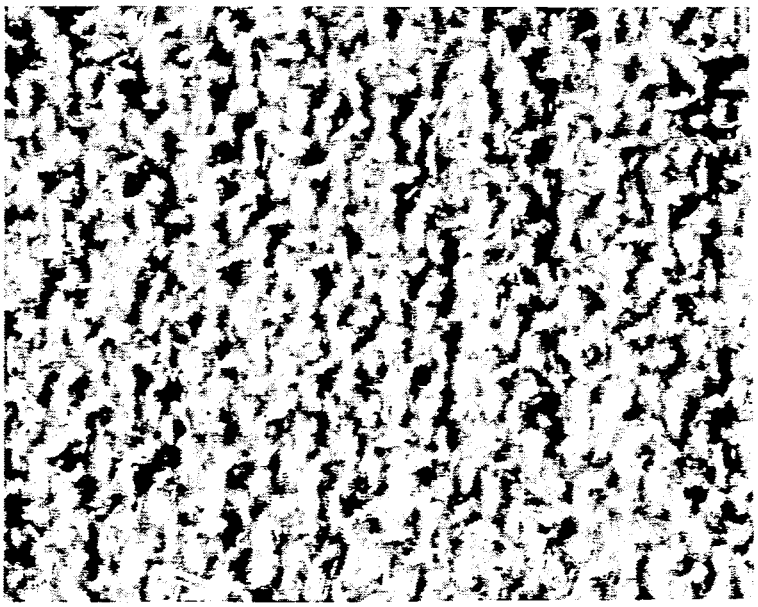
Figure 4A:
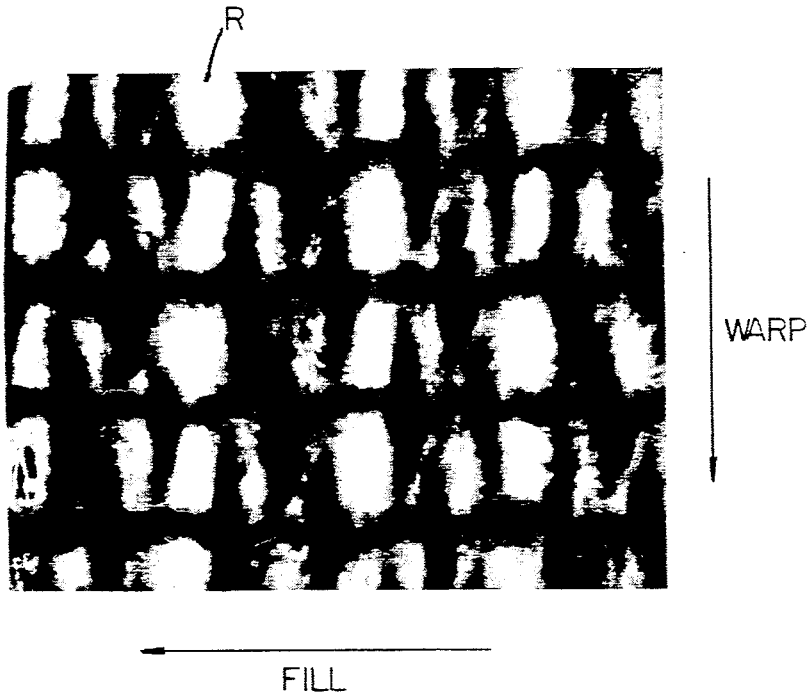
FIGS. 4A and B are photomicrographs at 16X magnification of the control and processed fabric of FIGS. 3A and B.

Conventional weaving processes impart reed marks to fabrics. Illustrations of such markings are shown in FIGS. 3A and 4A which are photomicrographs at 10X and 16X magnification of a polyester LIBBEY brand fabric style no. S/x-A805 (see Table II). Reed marks in FIGS. 3A and 4A are designated by the letter "R".

The invention overcomes this defect in conventional weaving processes through use of a single and preferably two stage hydroenhancement process. Advantage is obtained in the invention process by orienting the drum support member 34 in offset relation, preferably 45°, relative to machine direction ("MD") of the hydroenhancing line. See FIGS. 2A and B.

Support members 22 and 34 are preferably provided with fine mesh open areas which are dimensioned to effect fluid passage through the members without imparting a patterned effect to the fabric. The preferred members have an effective open area for fluid passage in the range of 17–40%.

Comparison of the control and processed polyester fabric of FIGS. 3A, B and 4A, B illustrates the advantages obtained through use of the enhancement process. Reed marks R in control polyester fabric are essentially eliminated through enhancement of the fabric. The offset screen arrangement is also effective in diminishing linear jet streak markings associated with the enhancement process.

EXAMPLES I–XIII

FIGS. 3–15 illustrate representative woven and knit fabrics enhanced in accordance with the method of the invention, employing test conditions which simulate the line of FIG. 1 (hereinafter the "Prototype FIG. 1 line"). Table II sets forth specifications for the fabrics illustrated in the drawings.

As in the FIG. 1 line, the test manifolds 30 were spaced approximately 8 inches apart in modules 16, 18, and provided with densely packed columnar jet orifices 32 of approximately 60/inch. Orifices 32 each had a diameter of 0.005 inches and were spaced approximately 0.5 inches from the first and second support members 22, 34.

The process line of FIG. 1 includes enhancement modules 16, 18 which, respectively, are provided with six manifolds. In the Examples, modules 16, 18 were each fitted with two manifolds 34. To simulate line conditions, the fabrics were advanced through multiple runs on the line. Three processing runs in each two manifold module was deemed to be equivalent to a six manifold module.

Fabrics were hydroenhanced at process pressures of approximately 1500 psi. Line speed and cumulative energy output to the modules were respectively maintained at approximately 30 fpm and 0.46 hp-hr/lb. Adjustments in the line speed and fluid pressure were made to accommodate differences in fabric weight for uniform processing and to maintain the preferred energy level.

Fabrics processed in the Examples exhibited marked enhancement in aesthetic appearance and quality including, characteristics such as cover, bloom, abrasion resistance, drape, stability, and reduction in seam slippage, and edge fray.

Tables III–XI set forth data for fabrics enhanced in accordance with invention on the test process line. Standard testing procedures of The American Society for Testing and Materials (ASTM) were employed to test control and processed characteristics of fabrics. Data set forth in the Tables was generated in accordance with the following ASTM standards:

| Fabric Characteristic | ASTM Standard |
|---|---|
| Weight | D3776-79 |
| Thickness | D1777-64 (Ames Tester) |
| Tensile Load | D1682-64 (1975) (Cut strip/grab) |
| Elongation | D1682-64 (1975) |
| Air Permeability | D737-75 (1980) (Frazier) |
| Thread Count | D3775-79 |
| Ball Burst | D3787-80A |
| Slippage | D4159-82 |
| Tongue Tear | D2261-71 |
| Wrinkle Recovery | D1295-67 (1972) |
| Abrasion Resistance | D3884-80 |
| Pilling | D3514-81 |

Washability tests were conducted in accordance with the following procedure. Weight measurements ("before wash") were taken of control and processed fabric samples each having a dimension of 8.5"×11" (8.5" fill direction and 11" warp direction). The samples were then washed and dried in conventional washer and dryers three consecutive times and "after wash" measurements were taken. The percent weight loss of the pre and post wash samples was determined in accordance the following formula:

$$\%\ weight\ loss = D/B \times 100$$

where, B=before wash sample weight; A=after wash sample weight; and D=B-A.

Photomicrographs of the fabrics, FIGS. 4–15, illustrate the enhancement in fabric cover obtained in the invention. Attention is directed to open areas in the unprocessed fabrics, photographs designated A, these areas are of reduced size in the processed fabrics in the photographs designated B. Hydroenhancement caused fabric yarns to bloom and entangle at cross-over points, filling in open areas to improve cover and reduce air permeability in the fabrics.

Figure 12A:
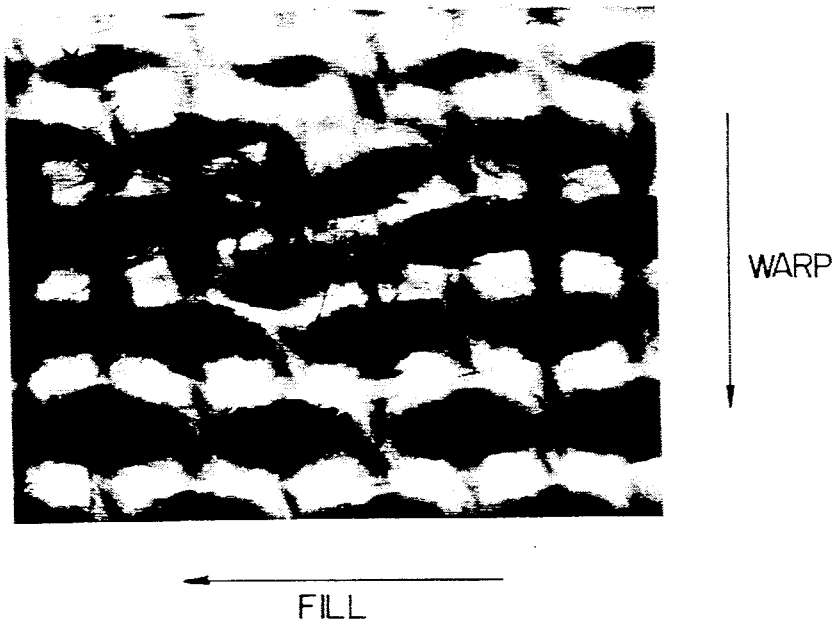
FIGS. 12A and B are front and back side photomicrographs at 16X magnification of a control wall covering fabric.
Figure 12B:
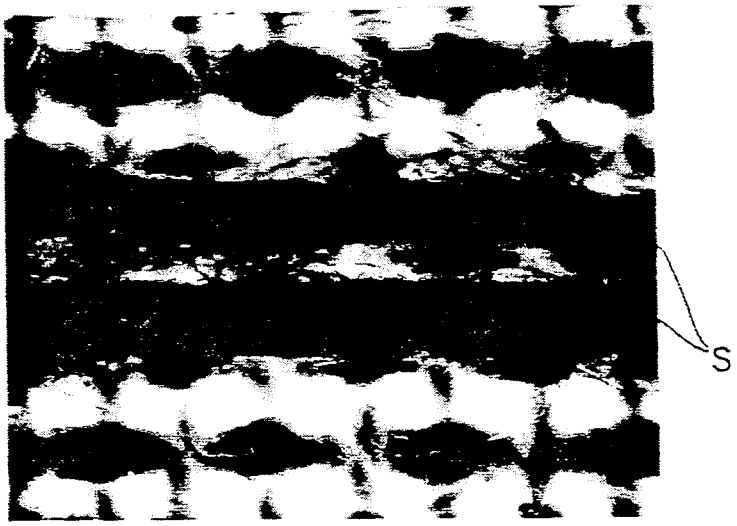
Figure 13A:
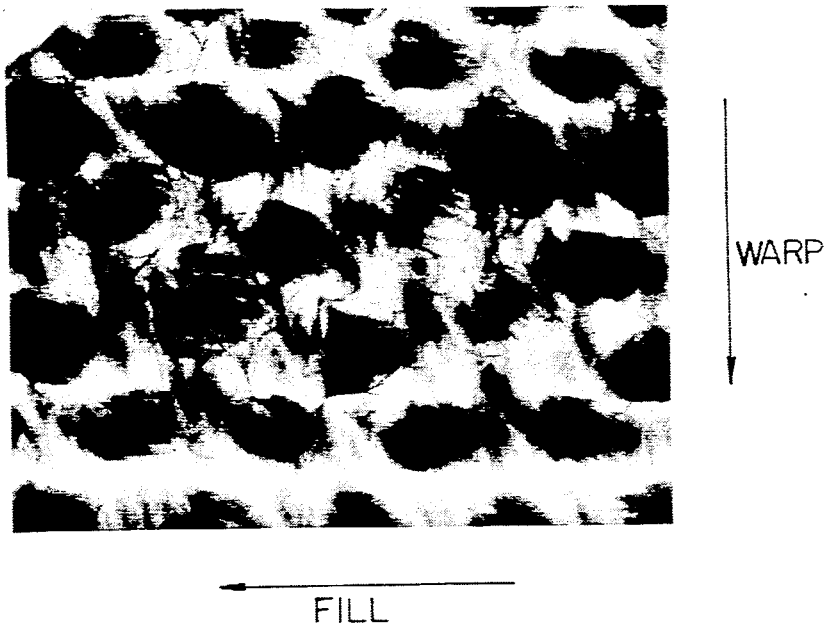
FIGS. 13A and B are front and back side photomicrographs at 16X magnification of the wall covering fabric of FIGS. 12A and B hydroenhanced in accordance with the invention.
Figure 13B:
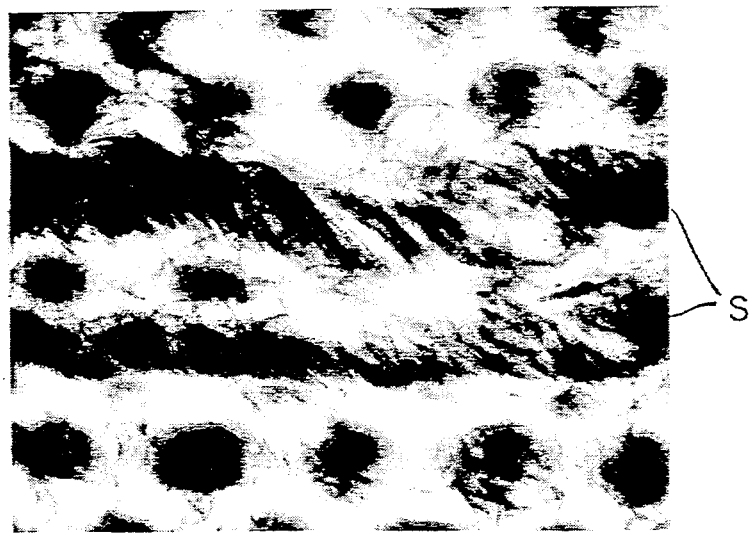

FIGS. 12 and 13 are photomicrographs of a HYTEX brand wall covering fabric, manufactured by Hytex, Inc, Randolph, Mass. A multi-textured surface appearance of the fabric is provided by yarns which are woven through discrete areas of the front fabric surface. Free floating weave stitches, designated by the letter "S" in FIGS. 12B and 13B, are formed on the backside of the fabric.

Hydroenhancement of HYTEX wall covering fabric secured the free-floating stitches S to the fabric backside enhancing fabric stability and cover. See FIGS. 12B, 13B. In wall covering applications, fabric enhancement and associated stabilizing effects reduces or eliminates the need for adhesive backcoatings. Enhancement of the fabric also limits wicking of wall cover application adhesives through the fabric. Further advantage is obtained when enhanced fabrics are used in acoustic applications; elimination of backcoating reduces sound reflection and furthers efficient transmission of sound through the fabric.

TABLE II

| Fabric Specifications | |
|---|---|
| Fiber Brand and Style Designation | FIG(S). |
| NOMEX S/x-A805* | 3A,B, 4A,B |
| Fiber: 2 denier-1.9 inch | |
| Yarn: Open end cotton spun 17s | |
| LIBBEY S/022** | 5A,B |
| Warp: | |
| Fiber: 3 denier - 1.5 inch acrylic | |

TABLE II-continued

| Fabric Specifications<br>Fiber Brand and Style Designation | FIG(S). |
|---|---|
| Yarn: Open end cotton spun 9s<br>28 ends per inch | |
| Fill: | |
| Fiber: 3 denier - 3 inch acrylic | |
| Yarn: Open end wool spun 4s<br>14, 16 or 18 picks per inch | |
| LIBBEY S/x-1160 | 6A,B |
| Fiber: 3 denier-3 inch acrylic | |
| Yarn: Wrap spun w/100 den<br>textured polyester 4s | |
| 14 ends × 16 picks per inch | |
| LIBBEY S/406 | 7A,B, 14A,B |
| Warp: | |
| Fiber: 3 denier - 1.5 inch acrylic | |
| Yarn: Open end cotton spun 9s<br>28 ends per inch | |
| Fill: | |
| Fiber: 3 denier - 3 inch acrylic | |
| Yarn: Hollow spun 6 twists/inch 4s<br>14; 16 or 18 picks per inch | |
| LIBBEY S/152 | 8A,B |
| Warp: | |
| Fiber: 3 denier - 2.5 inch acrylic | |
| Yarn: Open end cotton spun 4s<br>14 ends per inch | |
| Fill: | |
| Fiber: 3 denier - 3 inch acrylic | |
| Yarn: Open end wool spun 2.6s<br>14, 16 or 18 picks per inch | |
| Guilford Wool/Nylon<br>80% wool/20% nylon | 9A,B |
| Polyester/cotton (53/47) | 10A,B |
| Weight: 10 ounces/yd2 | |
| Yarn: Spun Filament | |
| Weave: 3 × 1 Twill | |
| Thread Count: 120 × 38 | |
| 50% Polyester/50% cotton Doubleknit | 11A,B |
| Yarn: wrap spun with 100<br>denier polyester wrap | |
| HYTEX Wall covering*** | 12, 13 |

*LIBBEY is a trademark of W. S. Libbey Co., One Mill Street, Lewiston, ME 04240.
**NOMEX is a trademark of E.I. Du Pont de Nemours and Company, Wilmington, Del.
***HYTEX is a trademark of Hytex, Inc., Randolph, MA.

TABLE III

Figure 4B:
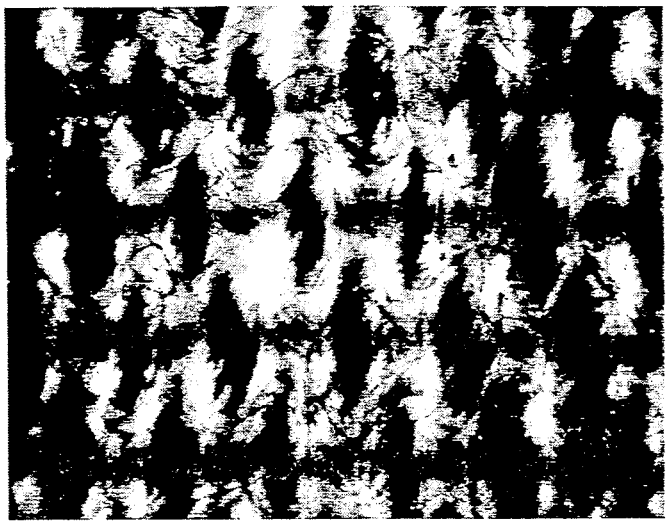

| Nomex A805 - FIG. 4 | Control | Processed | % Chance |
|---|---|---|---|
| Weight (gsy) | 195 | 197 | +1.0 |
| Thickness (mils) | 42 | 42 | 0 |
| Air Perm. ($ft^3/ft^2$/min) | 331 | 156 | −52.9 |
| Strip Tensile (lbs/in) | | | |
| warp | 115 | 132 | +14.8 |
| fill | 59 | 47 | −20.3 |
| Elongation (%) | | | |
| warp | 48 | 50 | +4.2 |
| fill | 62 | 71 | +14.5 |

TABLE IV

Figure 5A:
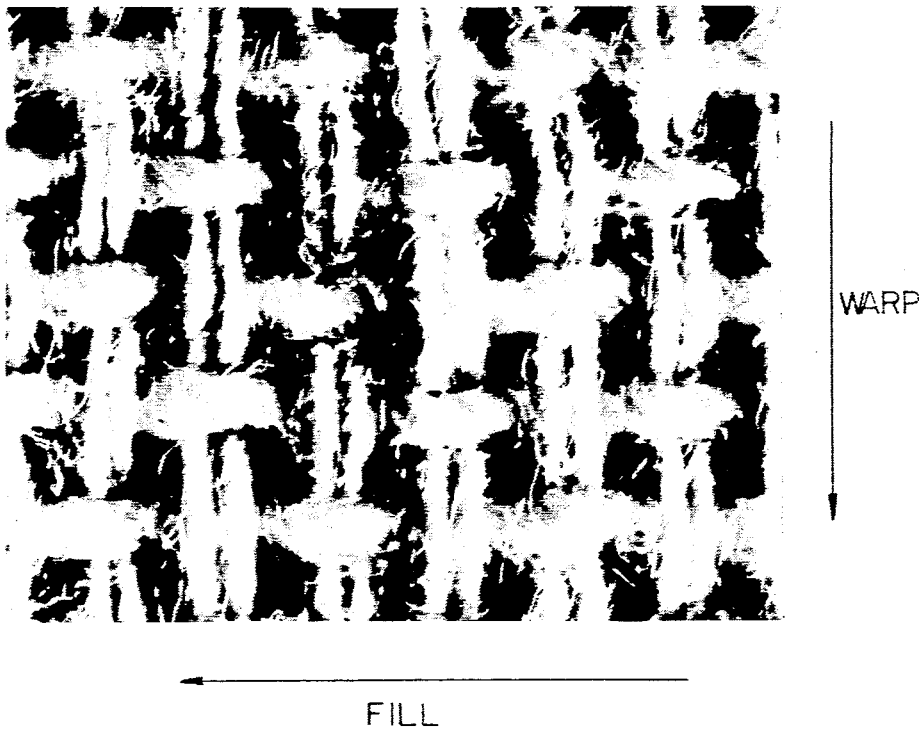
FIGS. 5A and B are photomicrographs at 10X magnification of a control and hydroenhanced woven acrylic fabric.
Figure 5B:
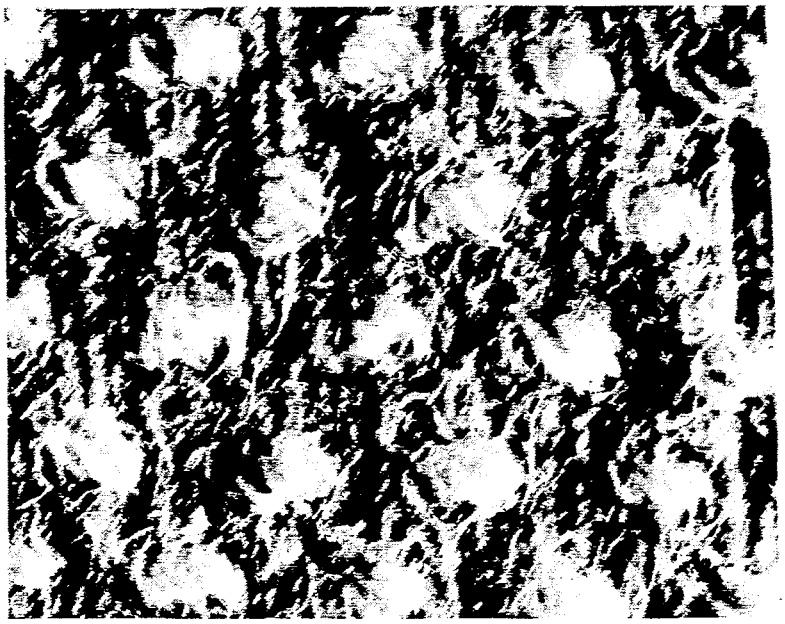

| 022/6075 (16 ppi) - FIG. 5 | Control | Processed | % Change |
|---|---|---|---|
| Weight (gsy) | 158 | 165 | +4.4 |
| Thickness (mils) | 48 | 49 | +2.1 |
| Air Perm. ($ft^3/ft^2$ min) | 406 | 259 | −36.2 |
| Strip Tensile (lbs/in) | | | |
| warp | 34 | 36 | +5.9 |
| fill | 37 | 31 | −16.2 |
| Elongation (%) | | | |
| warp | 33 | 27 | −18.2 |

TABLE IV-continued

| 022/6075 (16 ppi) - FIG. 5 | Control | Processed | % Change |
|---|---|---|---|
| fill | 27 | 28 | +3.7 |
| Seam Slippage (lbs/in) | | | |
| warp | 5 | 60 | +1100.0 |
| fill | 7 | 55 | +685.7 |
| Tongue Tear (lbs) | | | |
| warp | 18 | 10 | −44.4 |
| fill | 21 | 8 | −61.9 |
| Wt. Loss In Wash (%) | 37 | 5 | −86.5 |
| Wrinkle Recovery* (recovery angle) | 123° | 138° | +12.2 |

*Under ASTM test standards (D1295-67) improvements in the wrinkle recovery of a fabric are indicated by an increase in the recovery angle.

TABLE V

Figure 6A:
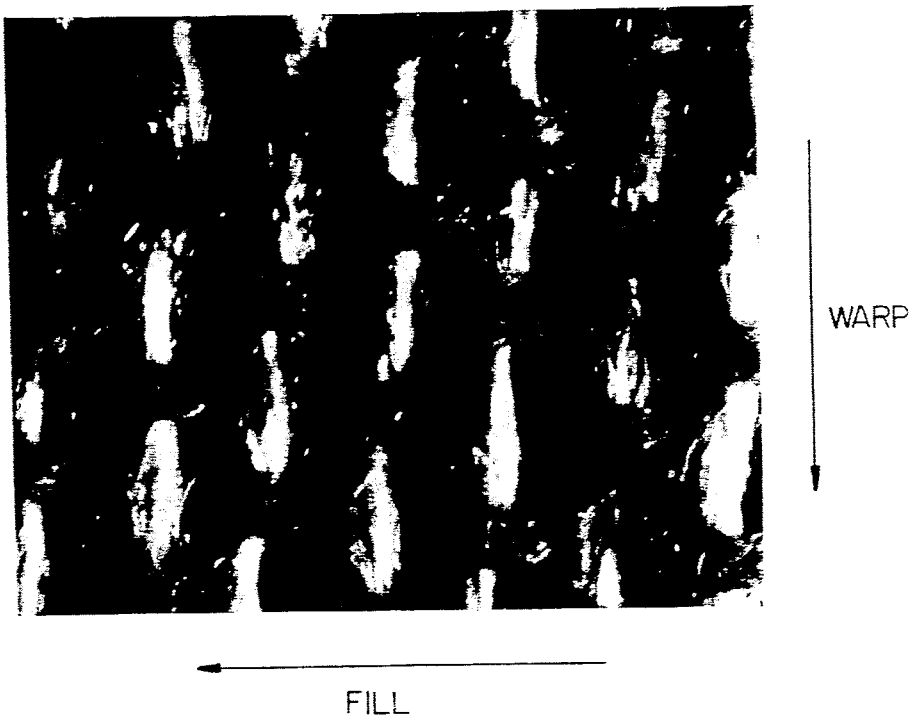
FIGS. 6A and B are photomicrographs at 10X magnification of a control and hydroenhanced acrylic fabric woven of wrap spun yarn.
Figure 6B:
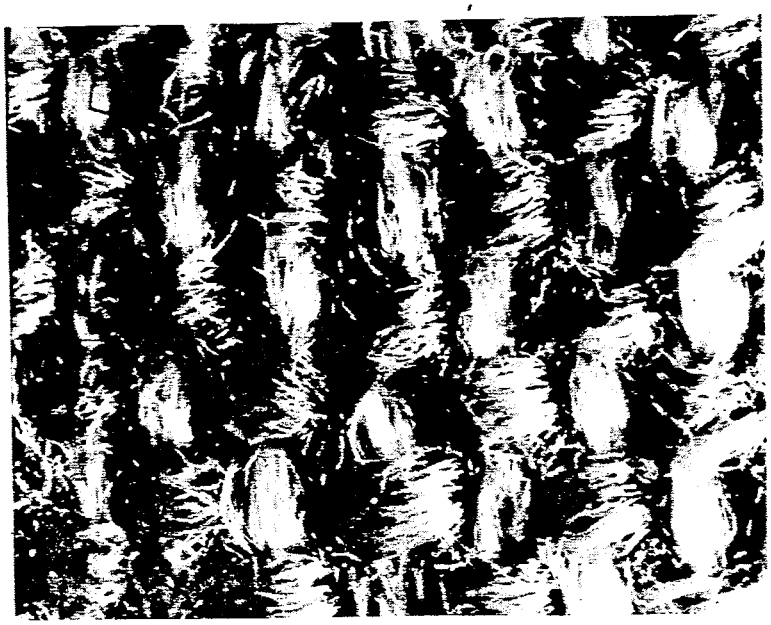

| Libbey S/x-1160 - FIG. 6 | Control | Processed | % Change |
|---|---|---|---|
| Weight (gsy) | 146.8 | 160.2 | 9.1 |
| Thickness (mils) | 38.1 | 52.7 | 38.3 |
| Air Perm. ($ft^3/ft^2$ min) | 457.2 | 188.5 | −58.8 |
| Grab Tensile (lbs/in) | | | |
| warp | 80.2 | 89.3 | 11.4 |
| fill | 105.0 | 111.4 | 6.1 |
| Elongation (%) | | | |
| warp | 30.0 | 34.0 | 13.3 |
| fill | 32.0 | 46.0 | 43.8 |
| Ball Burst (lbs) | 190 | 157 | −17.4 |

TABLE VI

Figure 7A:
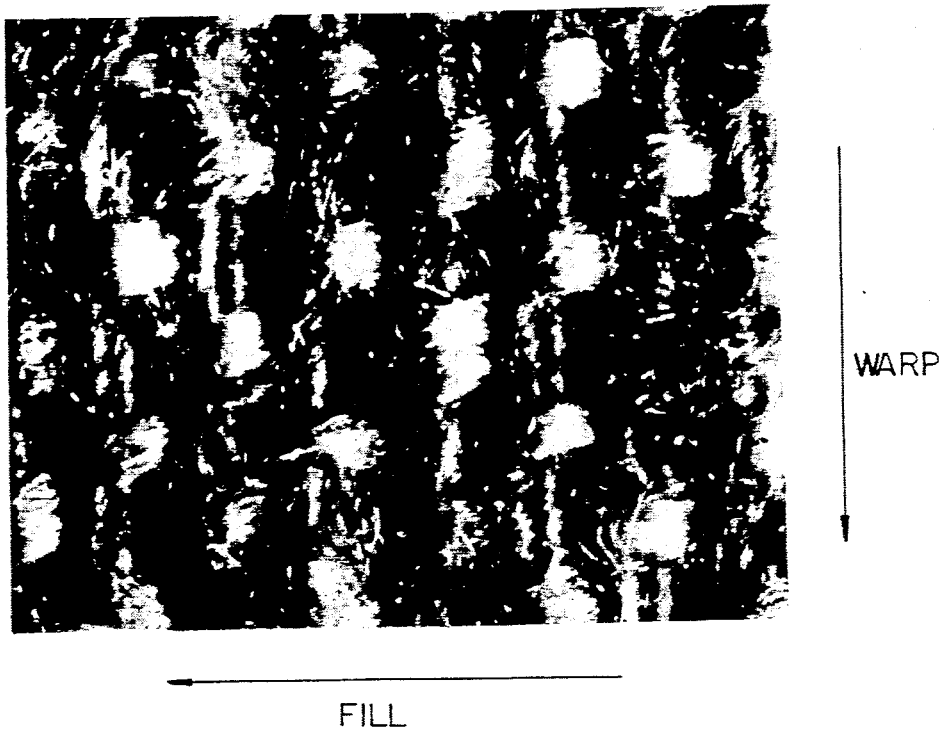
FIGS. 7A and B are photomicrographs at 10X magnification of a control and hydroenhanced acrylic fabric woven of wrap spun yarn.
Figure 7B:
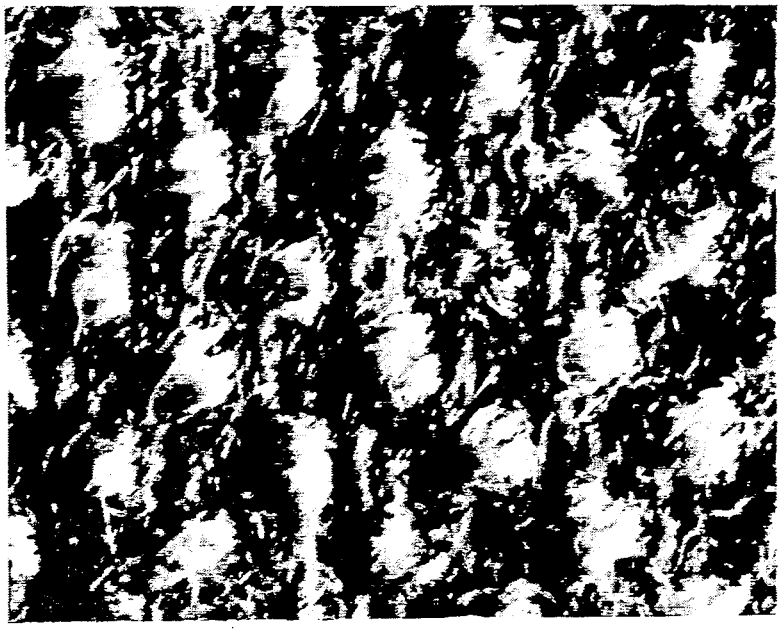

| 406/6075 (16 ppi) - FIG. 7 | Control | Processed | % Change |
|---|---|---|---|
| Weight (gsy) | 159 | 166 | +4.4 |
| Thickness (mils) | 48 | 50 | +4.2 |
| Air Perm. ($ft^3/ft^2$ min) | 351 | 184 | −47.6 |
| Strip Tensile (lbs/in) | | | |
| warp | 42 | 36 | −14.3 |
| fill | 66 | 58 | −12.1 |
| Elongation (%) | | | |
| warp | 23 | 31 | +34.8 |
| fill | 49 | 33 | −32.7 |
| Seam Slippage (lbs) | | | |
| warp | 29 | 36 | +89.5 |
| fill | 21 | 76 | +261.9 |
| Tongue Tear (lbs) | | | |
| warp | 23 | 18 | −21.7 |
| fill | 19 | 15 | −1.1 |
| Wt. Loss In Wash (%) | 28 | 4 | −85.7 |
| Wrinkle Recovery (recovery angle) | 140° | 148° | +5.7 |

TABLE VII

Figure 8A:
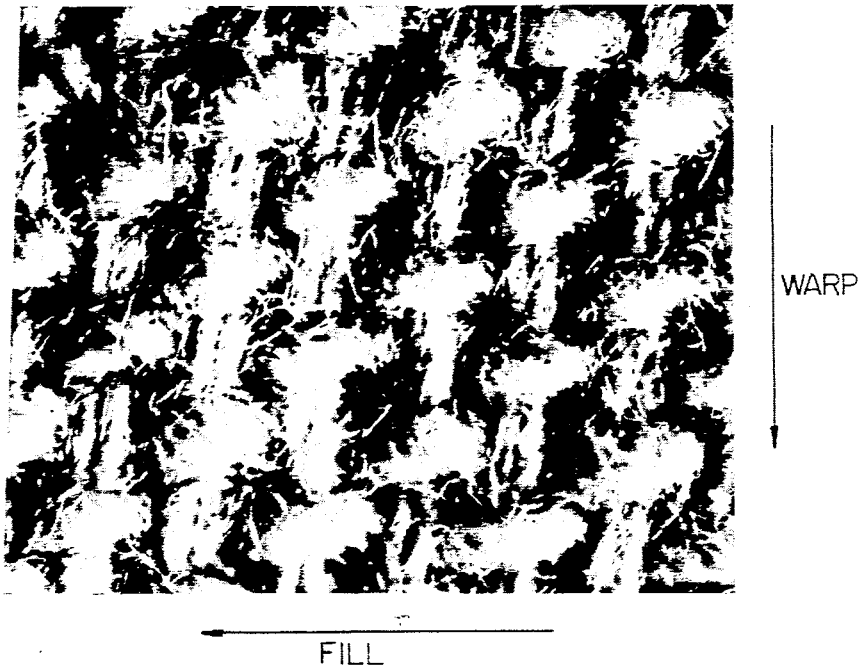
FIGS. 8A and B are photomicrographs at -10X magnification of a control and hydroenhanced acrylic fabric including open end wool spun yarn.
Figure 8B:
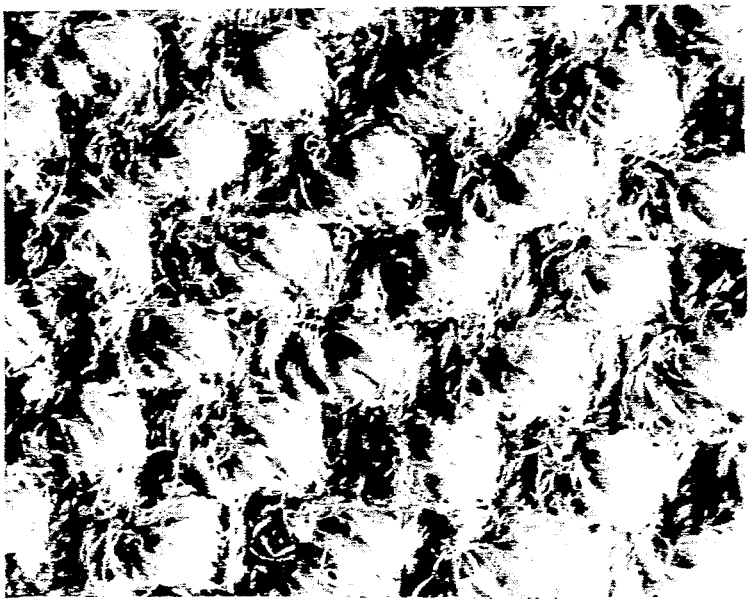

| 152/6076 (16 ppi) - FIG. 8 | Control | Processed | % Change |
|---|---|---|---|
| Weight (gsy) | 231 | 257 | +11.3 |
| Thickness (mils) | 259 | 238 | −8.1 |
| Air Perm. ($ft^3/ft^2$/min) | 204 | 106 | −48.0 |
| Strip Tensile (lbs/in) | | | |
| warp | 48 | 58 | +20.8 |
| fill | 56 | 72 | +28.6 |
| Elongation (%) | | | |
| warp | 33 | 33 | 0 |
| fill | 34 | 39 | +14.7 |
| Seam Slippage (lbs) | | | |
| warp | 64 | 81 | +26.6 |
| fill | 78 | 112 | +43.6 |
| Tongue Tear (lbs) | | | |

TABLE VII-continued

| 152/6076 (16 ppi) - FIG. 8 | Control | Processed | % Change |
|---|---|---|---|
| warp | 21 | 18 | −14.3 |
| fill | 17 | 15 | −11.8 |
| Wt. Loss In Wash (%) | — | — | — |
| Wrinkle Recovery (recovery angle) | 117° | 136° | +16.2 |

TABLE VIII

Figure 9A:
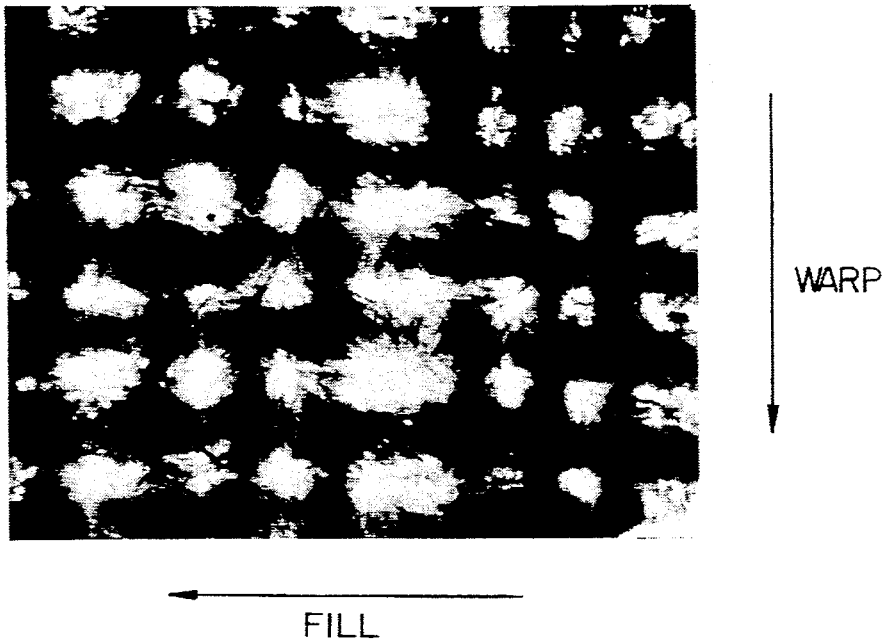
FIGS. 9A and B are photomicrographs at 16X magnification of a control and hydroenhanced wool nylon (80/20%) fabric.
Figure 9B:
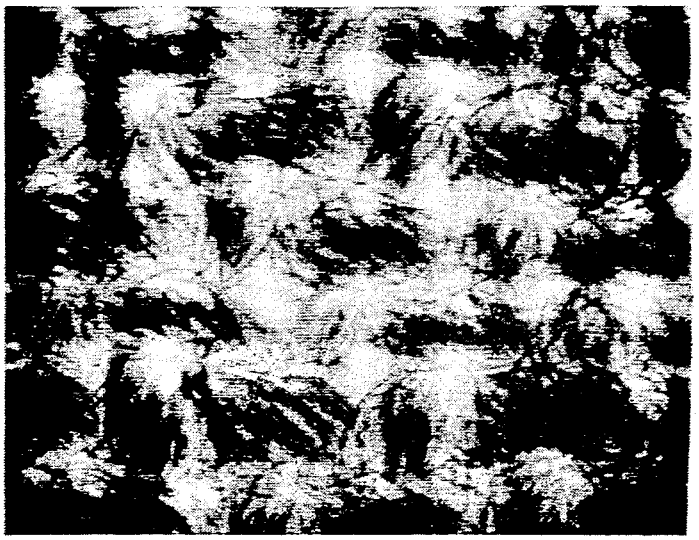

| Guilford Wool (80% wool/20% nylon) - FIG. 9 | Control | Process | % Change |
|---|---|---|---|
| Air Perm. | 243 | 147 | −39.5 |

TABLE IXA

Figure 10A:
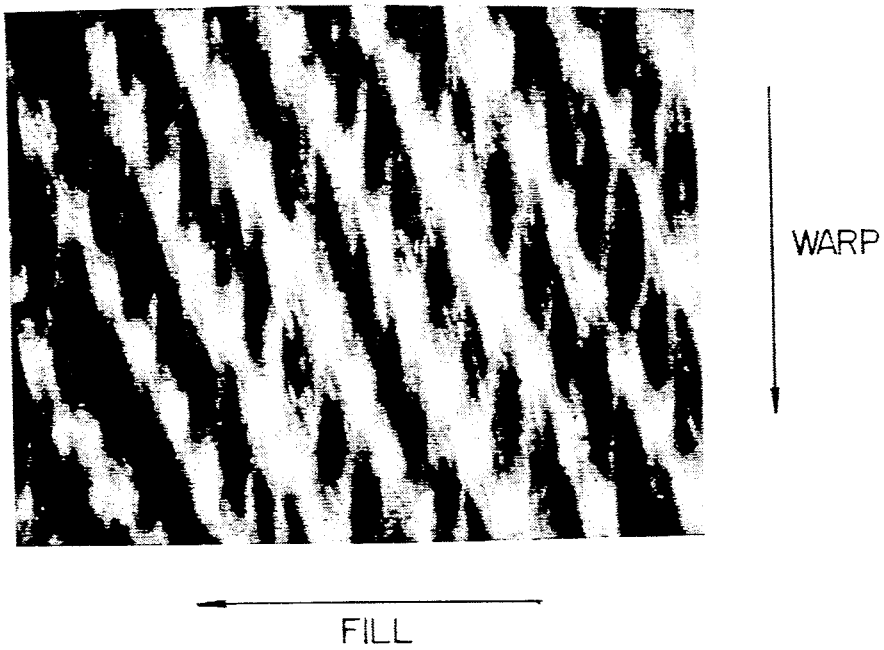
FIGS. 10A and B are photomicrographs at 16X magnification of a control and hydroenhanced spun/filament polyester/cotton twill fabric.
Figure 10B:
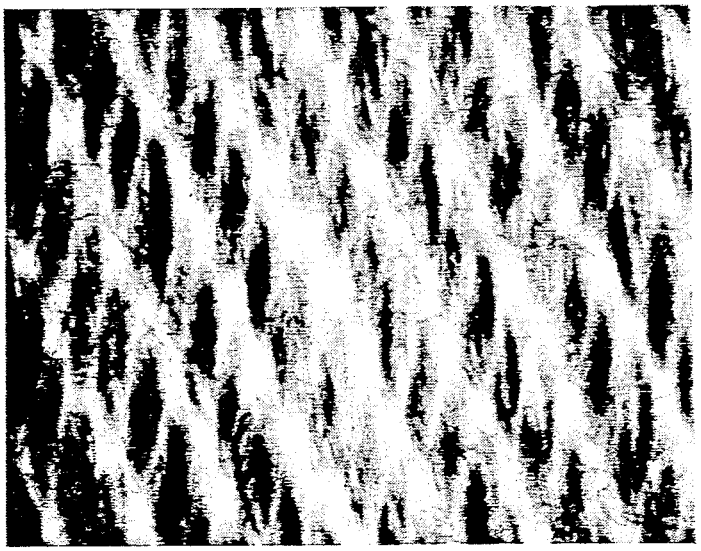

| Spun/Filament - Bottom Weights - FIG. 10 | Sample #1 | | Sample #2 | | Sample #3 | | Sample #4 | |
|---|---|---|---|---|---|---|---|---|
| | Control | Proc | Control | Proc | Control | Proc | Control | Proc |
| Weight (gsy) | 259.2 | 275.4 | 240.3 | 248.4 | 286.2 | 297.2 | 267.3 | 280.8 |
| Thickness (mils) | 39.7 | 39.2 | 35.0 | 35.3 | 44.2 | 41.5 | 40.0 | 38.0 |
| Strip Tensiles (lbs./in.) | | | | | | | | |
| Warp | 206.98 | 208.87 | 195.50 | 200.86 | 183.09 | 189.95 | 206.43 | 207.87 |
| Fill | 85.55 | 56.23 | 84.21 | 71.83 | 80.88 | 83.01 | 80.16 | 82.14 |
| Normalized Tensiles (lbs./in.) | | | | | | | | |
| Warp | 7.98 | 7.58 | 8.05 | 8.09 | 6.40 | 6.39 | 7.65 | 7.40 |
| Fill | 3.30 | 2.04 | 2.54 | 2.89 | 2.83 | 2.79 | 3.03 | 2.93 |
| Elongation (%) | | | | | | | | |
| Warp | 42.0 | 55.3 | 36.5 | 39.1 | 40.9 | 43.5 | 46.1 | 51.2 |
| Fill | 23.6 | 25.6 | 24.0 | 20.0 | 23.5 | 20.3 | 22.9 | 22.4 |
| Air Perm. ($ft.^3/ft.^2/min$) | 50.9 | 27.3 | 43.5 | 28.8 | 45.8 | 21.8 | 51.4 | 25.4 |
| Thread Count (wxf) | 120 × 40 | 120 × 41 | 120 × 45 | 120 × 45 | 120 × 38 | 120 × 42 | 120 × 42 | 120 × 43 |
| Mullen Burst (lbs.) | 161.2 | 222.2 | 187.2 | 228.8 | 161.0 | 217.8 | 205.0 | 242.2 |
| Normalized Burst (lbs./g × $10^2$) | 62.2 | 80.7 | 77.9 | 92.1 | 56.2 | 73.3 | 76.7 | 86.3 |

TABLE IXB

Abrasion - Spun Filament-Bottom Weights - FIG. 10
ASTM Standard - Twill side up; 500 cycles; 500 g weight; H-18 wheels

| Sample | Weight Before (g) | Weight After (g) | Weight Loss (g) | % Loss | % Improvement |
|---|---|---|---|---|---|
| 1C | 3.32 | 3.02 | 0.30 | 9.0 | |
| 1P | 3.36 | 3.13 | 0.23 | 6.9 | 23% |
| 2C | 4.64 | 4.16 | 0.48 | 10.4 | |
| 2P | 4.83 | 4.57 | 0.26 | 5.4 | 48% |
| 3C | 4.73 | 4.47 | 0.26 | 5.5 | |
| 3P | 4.91 | 5.13 | 0.22 | 4.5 | 18% |
| 4C | 4.47 | 4.18 | 0.29 | 6.5 | |
| 4P | 4.71 | 4.53 | 0.18 | 3.8 | 41% |

TABLE X

Figure 11A:
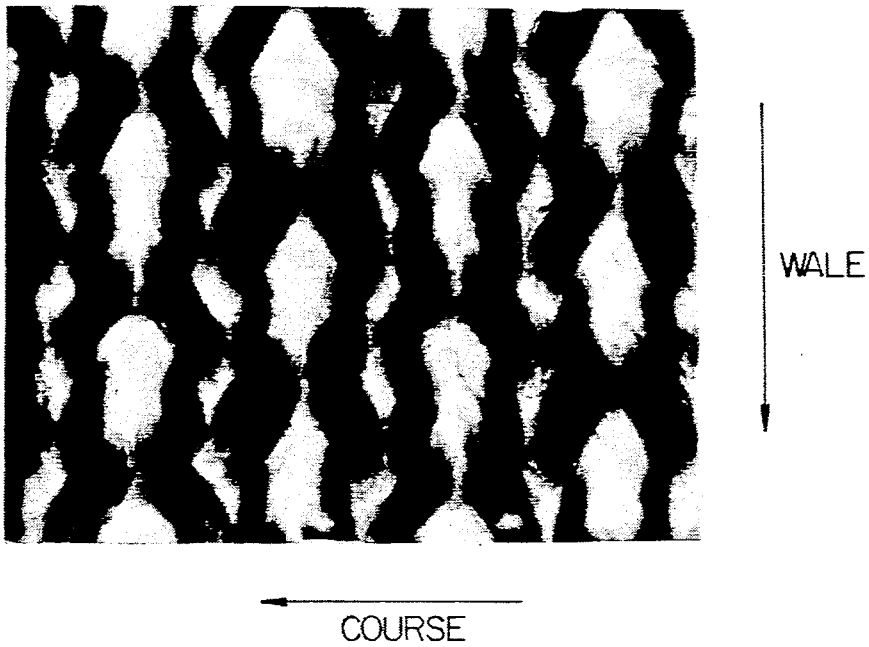
FIGS. 11A and B are photomicrographs at 16X magnification of a control and hydroenhanced doubleknit fabric.
Figure 11B:
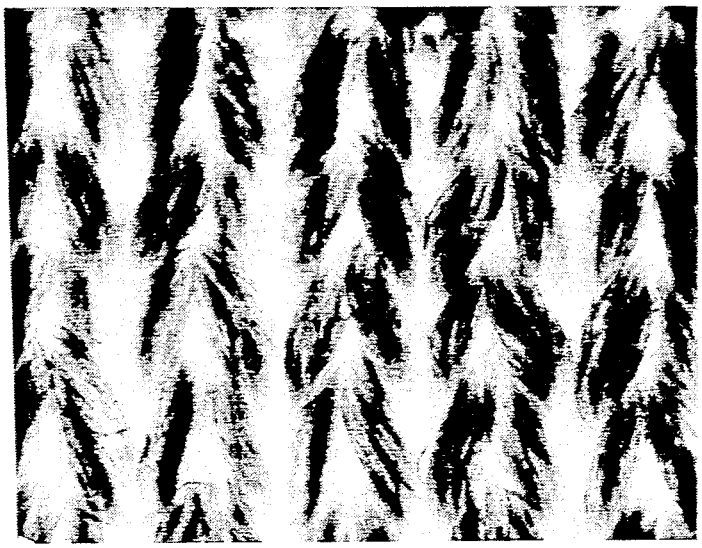

| Doubleknit - FIG. 11 | Control | Processed | % Change |
|---|---|---|---|
| Air Perm. ($Ft^3/ft^2$ min) | 113.1 | 95.1 | −15.9 |
| Abrasion ASTM (D-3884-80): 250 Cycles, H-18 wheel | 1.0 | 0.6 | −40.0 |
| Pilling (1–5 rating) ASTM (D-3914-81): 300 cycles | 4.3 | 4.3 | 0 |

Figure 14A:
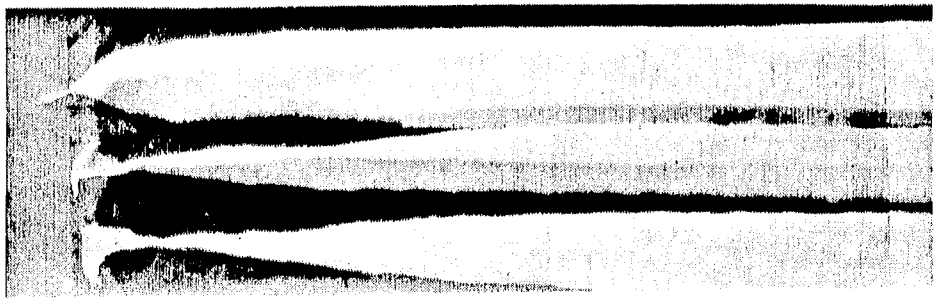
FIG. 14 is a photomacrograph at 0.09X magnification of a control and hydroenhanced acrylic fabric strips, the fabric of FIGS. 7A and B, showing the reduction in fabric torque achieved in the invention process.
Figure 14B:
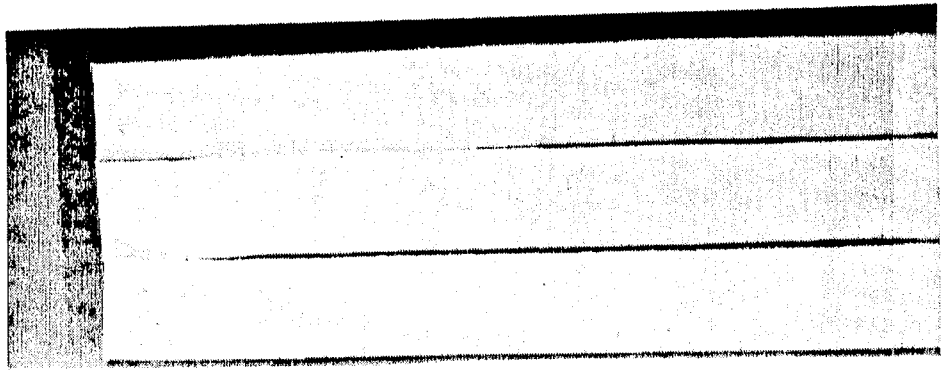

FIGS. 14A, B are photomacrographs of control and processed acrylic vertical blind fabric, manufactured by W. S. Libbey, style designation S/406. Enhancement of the fabric reduces fabric torque which is particularly advantageous in vertical blind applications The torque reduction test of FIGS. 14A, B employed fabric strips 84" long and 3.5" wide, which were suspended vertically without restraint. Torque was measured with reference to the angle of fabric twist from a flat support surface. As can be seen in the photographs, a torque of 90° in the unprocessed fabric, FIG. 14A, was eliminated in the enhancement process.

Figure 15A:
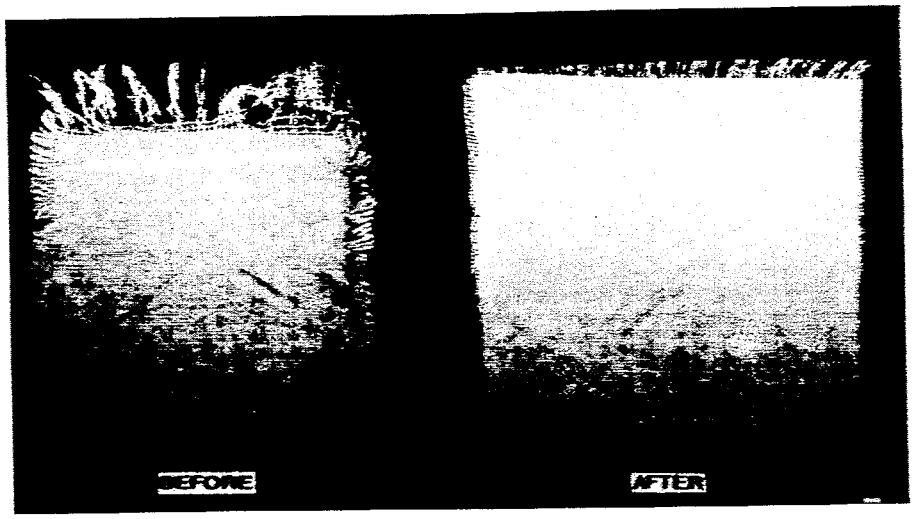
FIGS. 15 A-C are photomacrographs at 0.23X magnification, respectively, of the woven acrylic fabrics of FIGS. 5, 7 and 8, 0 comprised of wrap spun and open end wool spun yarns, showing washability and wrinkle characteristics of control and processed fabrics.
Figure 15B:
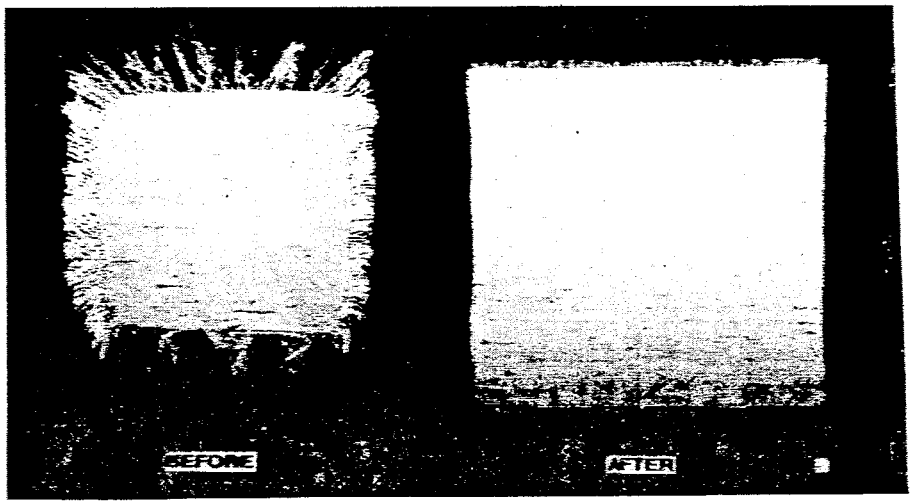
Figure 15C:
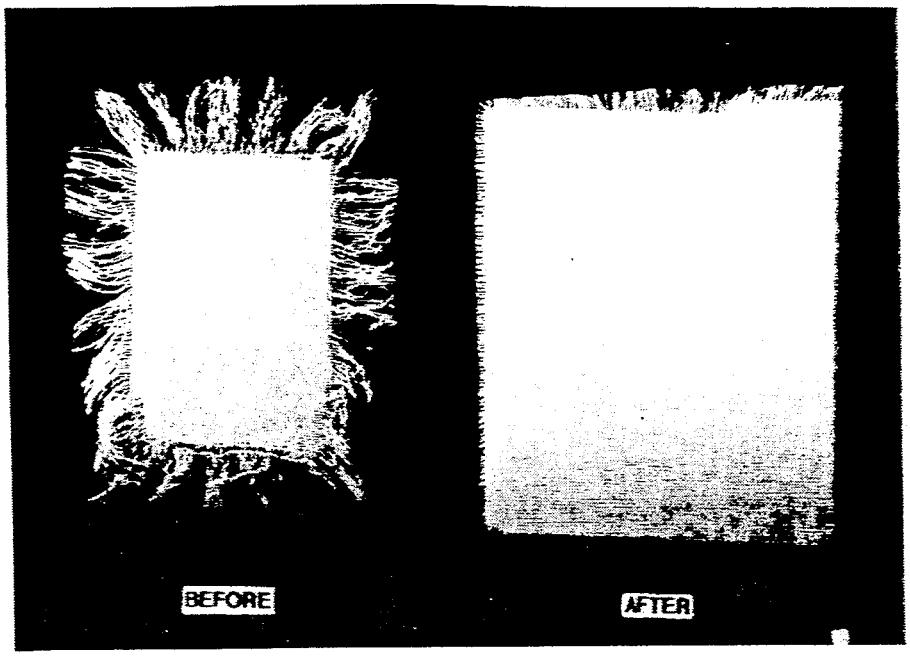

FIGS. 15A–C are macrophotographs of control and processed acrylic fabrics, LIBBEY style nos. 022, 406 and 152, respectively, which were tested for washability. Unprocessed fabrics exhibited excessive fraying and destruction, in contrast to the enhanced fabrics which exhibit limited fraying and yarn (weight) loss. Table XI sets forth washability test weight loss data.

TABLE XI

| 022, 406, 152 - FIGS. 15A–C Percent Weight Loss (3 wash/dry cycles) | | |
|---|---|---|
| Sample | Control | Processed |
| 022 | 36.5 | 5.0 |
| 406 | 28.0 | 4.0 |
| 152 | 28.1 | 7.2 |

In the foregoing Examples, the enhancement process of the invention is shown to yield improved textile finishing features such as, surface cover, abrasion resistance, wrinkle recovery, tensile strength and air permeability. Additional fabric features which may be obtained in the invention include, enhancement of fabric surface durability, absorption and adsorption, and shrinkage reduction. Further, advantageous fabric features are obtained in particular material applications of the invention enhancement process. For example, it has been found that enhancement of wool fabrics yields dense and compact fabrics which are shrink resistant. In another application of the invention technology improvements in fabric flame retardancy have been obtained in the processing of polyester based fabrics.

Examples illustrating further applications and embodiments of the invention are set forth below. As in the prior Examples, fabrics were processed on the Prototype FIG. 1 line described in the previous Examples. Fabrics were hydroenhanced at process pressures of approximately 1500 psi. Line speed and cumulative energy output to the entanglement modules were respectively maintained at approximately 30 fpm and 0.5 hp-hr/lb. Adjustments in the line speed and fluid pressure were made to accommodate differences in fabric weight for uniform processing and to maintain the preferred energy levels.

EXAMPLE XIV

Fabric Surface Durability

Conventional finishing processes for imparting surface durability to fabrics employ chemical binders which lock fabric fibers into stable orientations. Such "durable" or "permanent" press processes stiffen fabric finishes and adversely effect the hand and drape characteristics in fabrics. The hydroenhancement process of the invention imparts improved surface durability to fabrics without requirement of chemical treatment finishes. This result is obtained through stabilization of fabric matrix structures in the enhancement process through entanglement of yarns. Enhancement simulates fiber locking mechanisms of conventional chemical treatments.

Figure 16A:
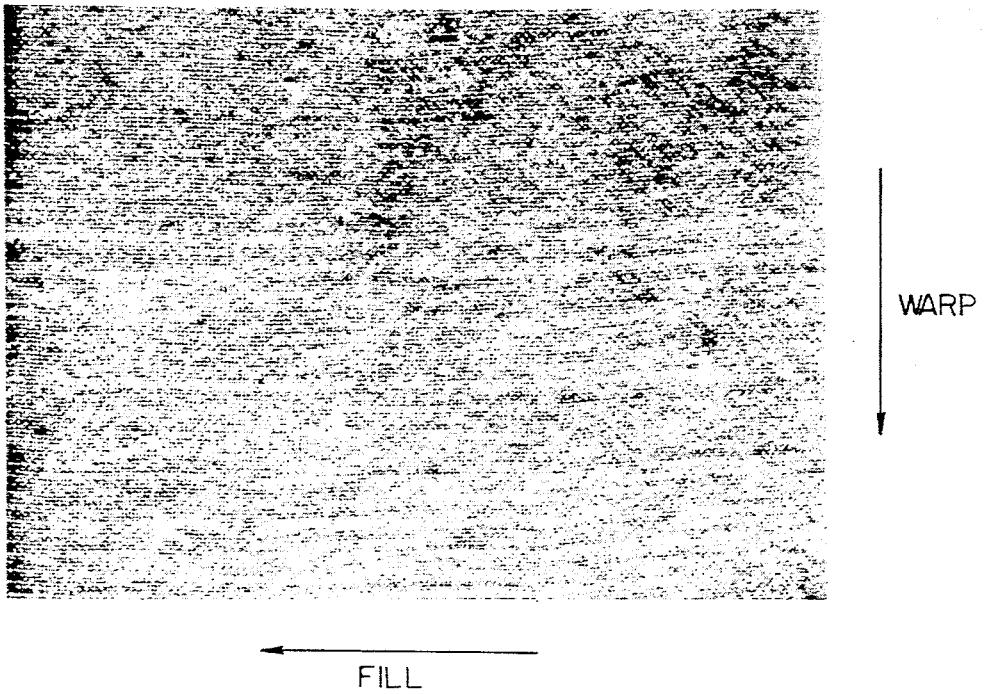
FIGS. 16A and B are photomacrographs at approximately 1X magnification of control and hydroenhanced acrylic fabric including wrap spun polyester yarns, showing washability and surface durability characteristics results obtained in the invention process.

FIGS. 16A,B–18A,B respectively, are macrophotographs of control and processed fabrics as follows: 1) acrylic fabric including wrap spun polyester yarn, 2) 100% polyester fabric including slub yarns, count of $16\times10$ yarns/in$^2$ and weight of 8 ounces/yd$^2$, and 3) Guilford 80% wool/20% nylon fabric (see Table II).

Durability was tested by subjecting the fabric samples to five (5) repeated wash-dry laundering treatments. Test conditions approximated conventional home laundry warm water washing and hot air drying conditions as defined in the AATCC Technical Manual, Test Method 124-1984. Control and process fabrics were mounted on boards and illuminated at an oblique angle by fluorescent light for macrophotographic comparison. Unprocessed fabrics were characterized by a roughened, mottled and nubby finish as compared with enhanced fabrics which exhibit smooth and pressed surface finishes.

EXAMPLE XV

Shrink-Resistance

Enhanced fabrics of the invention exhibit enhanced shrink resistance. Tables XII–XIV set forth shrinkage test data for wash/dry and dry cleaning processing of representative control and enhanced fabrics. Fabric shrinkage was measured by marking test fabrics with 10"×10" measurement lines. Following processing, shrinkage measurements were recorded with reference to line markings. As in prior Example XIV, laundering conditions approximated standards set forth in the AATCC Technical Manual, Test Method 124-1984.

Comparison of processed and control test data demonstrates that the invention enhancement obtains a measurable reduction in shrink resistance. For example, after five wash/dry cycles, enhanced 65% wool/-PET% exhibits a 6.9 percent shrinkage as compared to 14.4 percent shrinkage in an unprocessed control.

Attention is directed Table XIV which sets forth data for shrinkage in wool fabrics. It will be seen that stabilization in wool fabrics provides a "washable wool" without requirement of conventional chemical finishing treatment.

TABLE XII

SHRINKAGE - 5 WASH/DRY CYCLES
Warp/Fill (W/F) Measurements

| Original Sample 10" × 10" | | Measurement After Wash (inches) | | Percent Shrinkage | | Percent Area Shrinkage | |
|---|---|---|---|---|---|---|---|
| Sample | | Cont. | Proc. | Cont. | Proc. | Cont. | Proc. |
| Greige Cotton | W | 8.8 | 8.9 | 12 | 11 | 16.4 | 6.6 |
| Osnaburg | F | 9.5 | 10.5 | 5 | +5* | | |
| Bleached Cotton | W | 8.3 | 8.5 | 17 | 15 | 12.9 | 2.3 |
| Osnaburg | F | 10.5 | 11.5 | +5* | +1.5* | | |
| Wool/PET | W | 9.3 | 9.6 | 7 | 4 | 14.4 | 6.9 |
| 65/35 | F | 9.2 | 9.7 | 8 | 3 | | |
| Acrylic Tweed | W | 9.3 | 9.8 | 7 | 2 | 13.5 | 3.0 |
| | F | 9.3 | 9.9 | 7 | 1 | | |
| Acrylic Beige | W | 9.3 | 9.9 | 7 | 1 | 12.6 | 2.0 |
| | F | 9.4 | 9.9 | 6 | 1 | | |
| PET | W | 9.5 | 9.8 | 5 | 2 | 6.0 | 1.0 |
| | F | 9.9 | 10.1 | 1 | +1 | | |

*"+" indicates stretch - only in cotton fabrics

TABLE XIII

SHRINKAGE - 5 Dry Cleaning Cycles*
WOOL/PET and WOOL/NYLON
Warp/Fill (W/F) Measurements Original Sample: 10" × 10"

| | Wool/Pet 65/35 | | Wool/Nylon 80/20 | |
|---|---|---|---|---|
| | Size (in.) | Percent Shrinkage | Size (in.) | Percent Shrinkage |
| Control | | | | |
| W | 9.8 | 2.0 | 9.75 | 2.5 |
| F | 9.85 | 1.5 | 9.8 | 2.0 |
| Processed | | | | |
| W | 9.8 | 2.0 | 9.8 | 2.0 |
| F | 9.85 | 1.5 | 9.9 | 1.0 |

*Dry cleaning fluid: Perichlorethylene

TABLE XIV

WOOL SHRINKAGE
Samples marked 10" × 10"

| | Length | Width |
|---|---|---|
| Fine White Wool | | |
| Processed | 9.75 | 9.7 |
| Shrinkage (%) | 2.5 | 3.0 |
| Processed - 5 Wash/Dry | 8.7 | 8.7 |
| Shrinkage (%) | 13.0 | 13.0 |
| Control - 5 Wash/Dry | 8.3 | 8.2 |
| Shrinkage (%) | 17.0 | 18.0 |
| Coarse Blue Wool | | |
| Processed | 9.7 | 9.3 |
| Shrinkage (%) | 3.0 | 7.0 |
| Processed - 5 Wash/Dry | 8.0 | 8.0 |
| Shrinkage (%) | 20.0 | 20.0 |
| Control - 5 Wash/Dry | 7.8 | 7.7 |

TABLE XIV-continued

| WOOL SHRINKAGE Samples marked 10" × 10" | Length | Width |
|---|---|---|
| Shrinkage (%) | 22.0 | 23.0 |

EXAMPLE XVI

Absorption and Adsorption

Enhanced fabrics of the invention exhibit increased absorption and adsorption properties. Table XV sets forth data for ASTM water retention data for representative fabrics processed in accordance with the invention.

TABLE XV

| Absorptive Capacity Test Standard: ASTM D1117 - 5 sections | | | |
|---|---|---|---|
| Fabric | Untreated | Treated | Percent Increase |
| Osnaburg 100% Cotton | 11.7 | 12.9 | 10.3 |
| Acrylic | 16.8 | 21.8 | 29.8 |
| Wool/PET (65/35) | 19.7 | 23.2 | 17.8 |
| PET | 11.8 | 15.0 | 27.1 |

EXAMPLE XVII

Hydromilled Wood

Conventional fulling or felting processes are employed to finish woolen and worsted fabrics. In such processes the fabric is subjected to moisture, heat, friction, chemicals and pressure which cause the fabric fibers to mat and densify into a stable structure. Advantageously, it has found that comparable results are obtained in the present invention without requirement of conventional chemical and mechanical processing and associated degradation of the fabric.

Tables XVIA–C set forth comparative data for conventional fulled and hydroenhanced griege state wool fabrics. Control and conventional processed fabrics were obtained from Carleton Woolen Mills, Winthrop, Me.. The control griege state fabrics respectively had weights of 180.5, 252.7 and 145.9 gsy prior to application of hydroenhancing and conventional fulling processing. Hydroenhancement data is set forth for processing of each control fabric at energies of 0.5 and 1.0 hp-hr/lb. It will be seen that fabrics processed in accordance with the invention have physical properties which simulate those of the conventionally fulled fabrics.

Wool hydroenhancing ("Hydromilling") trials set forth in Tables XVIA–C were processed employing the Prototype FIG. 1 line. It is believed that further processing advantage in the hydromilling process could be obtained by use of hot fluid in the entanglement modules. For example, use of hot water in the line will further matting and mechanical entanglement of wool fibers. To this end it would also be advantageous to employ a hot water bath or feltng pre-entanglement process step in the invention.

TABLE XVI-A

| HYDROMILLED WOOL - Sample 1 | PROCESSED | | | |
|---|---|---|---|---|
| | CONTROL* | .5 hphr/lb | 1 hphr/lb | FINISHED** |
| WEIGHT (gsy) | 180.5 | 179.6 | 173.9 | 190.9 |
| THICKNESS (mils) | 53.2 | 53.6 | 52.9 | 34.3 |
| AIR PERM (cfm) | 329.5 | 214.0 | 212.0 | 117.4 |
| GRAB TENSILE (lbs) | | | | |
| WARP | 43.0 | 43.2 | 41.6 | 35.5 |
| FILL | 31.2 | 29.4 | 31.7 | 19.1 |
| ELONGATION (%) | | | | |
| WARP | 42.4 | 48.5 | 41.1 | 24.5 |
| FILL | 37.5 | 39.2 | 42.0 | 42.4 |
| TONGUE TEAR (lbs) | | | | |
| WARP | 6.5 | 5.2 | 5.4 | 3.0 |
| FILL | 8.3 | 7.0 | 6.3 | 4.4 |
| % SHRINKAGE (after 5 wash/dry) | | | | |
| WARP | 21.0 | 17.0 | | 27.8 |
| FILL | 16.0 | 17.0 | | 13.1 |
| TABER ABRASION (% weight loss) | 4.3 | 4.0 | 4.1 | 5.0 |
| % WOOL (Chem. extraction) | 99.9 | 100.0 | | |

*Griege state wool, manufactured by Carleton Woolen Mills, Winthrop, Maine.
**Conventional processed wool offered by Carleton Woolen Mills.

TABLE XVI-B

| HYDROMILLED WOOL - Sample 2 | PROCESSED | | | |
|---|---|---|---|---|
| | CONTROL* | .5 hphr/lb | 1 hphr/lb | FINISHED |
| WEIGHT (gsy) | 252.7 | 250.8 | 254.7 | 285.5 |
| THICKNESS (mils) | 69.9 | 70.8 | 71.4 | 106.6 |
| AIR PERM (cfm) | 214.5 | 127.3 | 120.6 | 138.6 |
| GRAB TENSILE (lbs) | | | | |
| WARP | 52.0 | 58.9 | 63.8 | 55.1 |
| FILL | 53.4 | 56.5 | 69.5 | 35.9 |
| ELONGATION (%) | | | | |
| WARP | 40.0 | 46.1 | 45.9 | 35.5 |
| FILL | 43.2 | 50.9 | 54.3 | 50.7 |

TABLE XVI-B-continued

| | HYDROMILLED WOOL - Sample 2 | | | |
|---|---|---|---|---|
| | | PROCESSED | | |
| | CONTROL* | .5 hphr/lb | 1 hphr/lb | FINISHED |
| TONGUE TEAR (lbs) | | | | |
| WARP | 16.7 | 14.8 | 14.6 | 6.6 |
| FILL | 17.5 | 15.4 | 13.9 | 8.7 |
| % SHRINKAGE (after 5 wash/dry) | | | | |
| WARP | 17.0 | 15.0 | | 16.9 |
| FILL | 14.0 | 7.0 | | 5.6 |
| TABER ABRASION (% weight loss) | 3.7 | 3.6 | 3.0 | 4.4 |
| % WOOL (Chem. extraction) | 80.3 | 79.8 | | |

*Griege state wool manufactured by Carleton Woolen Mills, Winthrop, Maine.

TABLE XVI-C

| | HYDROMILLED WOOL - Sample 3 | | | |
|---|---|---|---|---|
| | | PROCESSED | | |
| | CONTROL* | .5 hphr/lb | 1 hphr/lb | FINISHED |
| WEIGHT (gsy) | 145.9 | 147.7 | 147.3 | 146.9 |
| THICKNESS (mils) | 36.6 | 39.7 | 40.5 | 23.2 |
| AIR PERM (cfm) | 311.3 | 193.0 | 189.0 | 134.4 |
| GRAB TENSILE (lbs) | | | | |
| WARP | 40.7 | 37.7 | 39.5 | 30.4 |
| FILL | 37.3 | 36.5 | 31.8 | 22.9 |
| ELONGATION (%) | | | | |
| WARP | 40.5 | 43.2 | 39.5 | 23.7 |
| FILL | 41.1 | 47.7 | 43.0 | 39.2 |
| TONGUE TEAR (lbs) | | | | |
| WARP | 4.6 | 4.0 | 3.4 | 3.4 |
| FILL | 5.0 | 4.2 | 4.1 | 3.5 |
| % SHRINKAGE (after 5 wash/dry) | | | | |
| WARP | 18.0 | 11.0 | | 20.0 |
| FILL | 15.0 | 8.0 | | 8.1 |
| TABER ABRASION (% weight loss) | 5.0 | 4.5 | 4.7 | 7.2 |
| % WOOL (Chem. extraction) | 99.9 | 99.9 | | |

*Griege state wool manufactured by Carleton Woolen Mills, Winthrop, Maine.

EXAMPLE XIX

Flammability

Flame retardancy in conventionally known fabrics is generally obtained by chemical treatment of high melt point fiber based materials. For example, polyester has a melting point in the range of 480°-500° F. and has wide application in the manufacture of flame retardant materials. Such polyester materials are generally subjected to scouring to provide a contaminant free material which in turn is sealed with a chemical finish.

It has been found that polyester fabrics processed in accordance with the invention exhibit increased flame retardancy. Table XVII sets forth flammability test data for plain polyester fabrics samples hydroenhanced in accordance with the invention. Sample No. 1 designates control and process tests of enhanced fabric which include five (5) specimen trials. Comparative data is set forth for VISA and TREVIRA brand polyester fabrics.

Flame retardancy standards of NFPA are set forth in Table XVIII. The enhanced fabric exhibits flame retardancy properties which exceed those of the VISA and TREVIRA fabrics. It is believed that these results are a function of scouring aspects of the enhancement process as well as the improved stabilization of the fabric matrix obtained by entanglement of yarns. Further advantage in the invention may be obtained by provision of finishes to the fabric to limit introduction of contaminants to the processed fabric.

TABLE XVII

| | | NFPA 701 - SMALL SCALE POLYESTER FABRICS | | | | |
|---|---|---|---|---|---|---|
| | | BURN (12+ sec.) | | CHAR LENGTH (inches) | | |
| SAMPLE | SPECIMEN | warp | fill | warp | fill | COMMENTS |
| No. 1C | 1 | 34.6 | 76.4 | 10.0 | 10.0 | Burns with |
| | 2 | 93.7 | 52.6 | 10.0 | 10.0 | flame |
| CONTROL | 3 | 1.2 | 43.5 | 5.7 | 10.0 | |
| 5.5 osy | 4 | 32.0 | 13.4 | 10.0 | 6.7 | Some drips |
| | 5 | 47.0 | 27.6 | 10.0 | 10.0 | (1-13 sec.) |
| AVG. - 5 specimens | | 41.7 | 42.7 | 9.1 | 9.3 | |
| 10 specimens | | | | 9.2 | | |
| No. 1P | 1 | 3.9 | 0 | 4.0 | 4.5 | Melts and |

TABLE XVII-continued

| SAMPLE | SPECIMEN | NFPA 701 - SMALL SCALE POLYESTER FABRICS BURN (12+ sec.) warp | BURN (12+ sec.) fill | CHAR LENGTH (inches) warp | CHAR LENGTH (inches) fill | COMMENTS |
|---|---|---|---|---|---|---|
| | 2 | 0 | 0 | 5.0 | 3.8 | shrinks from |
| HYDROENHANCED | 3 | 10.1 | 23.1 | 4.2 | 4.0 | flame |
| 5.4 osy | 4 | 0 | 0 | 3.6 | 3.8 | Few drips |
| | 5 | 0 | 0 | 5.3 | 3.0 | (1 sec.) |
| AVG. - 5 specimens | | 2.8 | 4.6 | 4.4 | 3.8 | |
| 10 specimens | | | | 4.1 | | |
| No. 2 | 1 | 0 | 0 | 4.3 | 4.1 | Melts and |
| | 2 | 0 | 0 | 3.5 | 5.3 | shrinks |
| VISA* | 3 | 0 | 0 | 4.3 | 6.0 | from flame |
| FR treated | 4 | 0 | 0 | 4.1 | 5.8 | |
| 4.8 osy | 5 | 0 | 0 | 5.6 | 4.6 | |
| AVG. - 5 specimens | | 0 | 0 | 4.4 | 5.2 | |
| 10 specimens | | | | 4.2 | | |
| No. 3 | 1 | 3.8 | 10.7 | 4.0 | 4.9 | Burns with |
| | 2 | 0 | 6.8 | 4.8 | 4.8 | flame |
| TREVIRA** | 3 | 0 | 5.2 | 6.0 | 4.2 | |
| Inherently FR | 4 | 0 | 1.8 | 5.8 | 4.6 | Some drips |
| 4.2 osy | 5 | 0 | 2.1 | 4.9 | 5.2 | (1-13 sec.) |
| AVG. - 5 specimens | | 0.8 | 5.3 | 5.1 | 4.7 | |
| 10 specimens | | | | 5.1 | | |

*VISA is a trademark of Milliken Research Corporation, Spartanburg, South Carolina.
**TREVIRA is a trademark of Hoechst Celanese Corporation, Charlotte, North Carolina.

The following table from NFPA 701 sets forth the allowable limits for these fabrics.

TABLE XVIII

| Weight of Material Being Tested (oz per sq. yd.) | Permissible Length of Char or Destroyed Material - Small Scale Test: Maximum Average of 10 Specimens (inches) | Maximum Individual for Each Specimen (inches) |
|---|---|---|
| Over 10 | 3.5 | 4.5 |
| Over 6 and not exceeding 10 | 4.5 | 5.5 |
| Not exceeding 6 | 5.5 | 6.5 |

Figure 19:
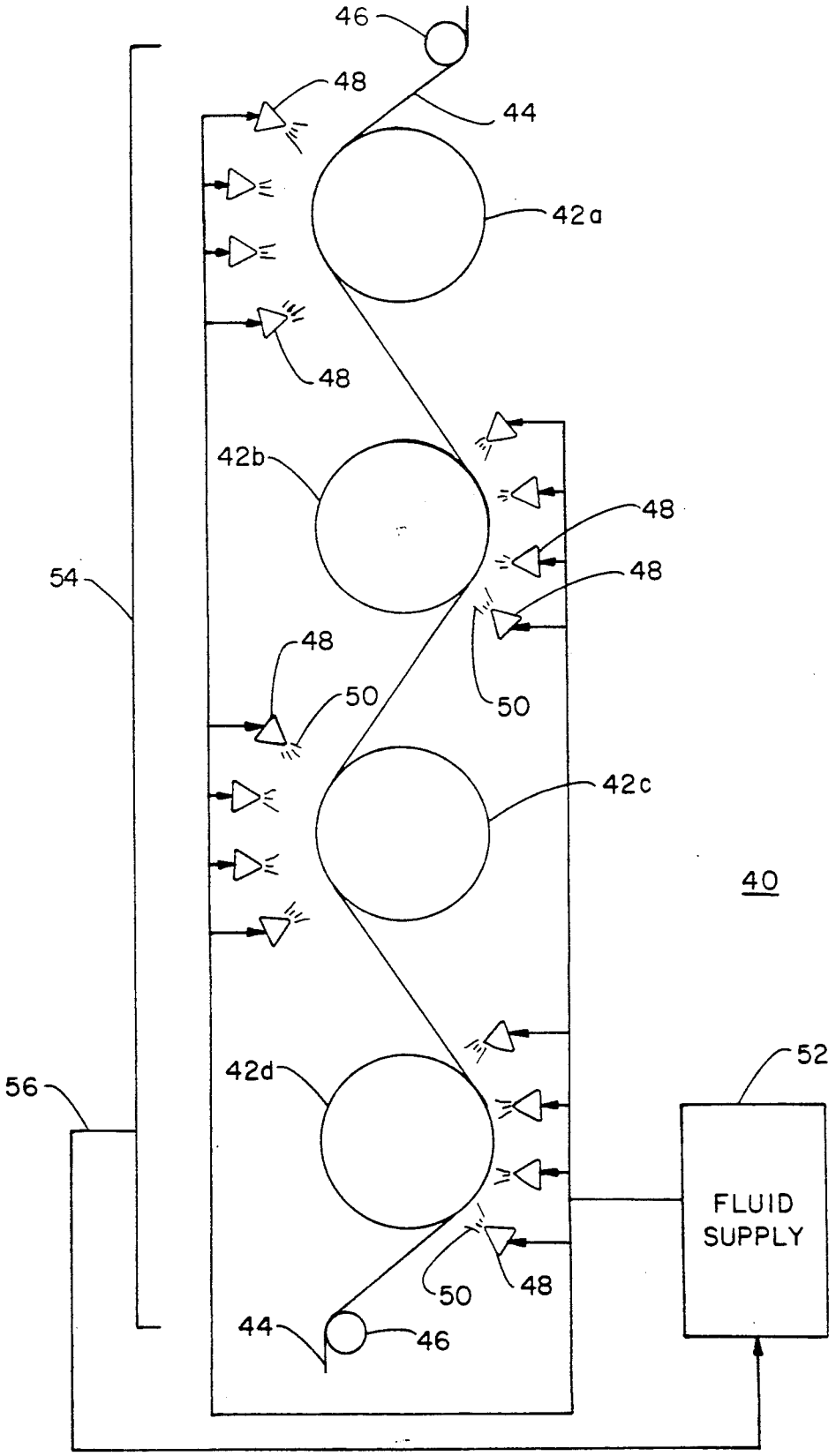
FIG. 19 is a schematic view of an alternative production line apparatus for the hydroenhancement of woven and knit fabrics in accordance with the invention.

FIG. 19 illustrates an alternative embodiment of the invention apparatus, generally designated 40. The apparatus includes a plurality of drums 42*a–d* over which a fabric 44 is advanced for enhancement processing. Specifically, the fabric 44 traverses the line in a sinuous path under and over the drums 42 in succession. Rollers 46*a* and *b* are provided at opposite ends of the line adjacent drums 42*a* and *d* to support the fabric. Any or all of the drums can be rotated by a suitable motor drive (not shown) to advance the fabric on the line.

A plurality of manifolds 48 are provided in groups, FIG. 19 illustrates groups of four, which are respectively spaced from each of the drums 42*a–d*. An arrangement of manifold groups at 90° intervals on the sinuous fabric path successively positions the manifolds in spaced relation with respect to opposing surfaces of the fabric. Each manifold 48 impinges columnar fluid jets 50, such as water, against the fabric. Fluid supply 52 supplies fluid to the manifolds 48 which is collected in liquid sump 54 during processing for recirculation via line 56 to the manifolds.

The support drums 42 may be porous or non-porous. It will be recognized that advantage is obtained through use of drums which include perforated support surfaces. Open areas in the support surfaces facilitate recirculation of the fluid employed in the enhancement process.

Further advantage is obtained, as previously set forth in discussion of the first embodiment, through use of support surfaces having a fine mesh open area pattern which facilitates fluid passage. Offset arrangement of the support member orientations, for example at 45° offset orientation as shown in FIG. 2, limits process water streak and weave reed marks in the enhanced fabric.

Enhancement is a function of energy which is imparted to the fabric. Preferred energy levels for enhancement in accordance with the invention are in the range of 0.1 to 2.0 hp-hr/lb. Variables which determine process energy levels include line speed, the amount and velocity of liquid which impinges on the fabric, and fabric weight and characteristics.

Fluid velocity and pressure are determined in part by the characteristics of the fluid orifices, for example, columnar versus fan jet configuration, and arrangement and spacing from the process line. It is a feature of the invention to impinge a curtain of fluid on a process line to impart an energy flux of approximately 0.46 hp-hr/lb to the fabric. Preferred specifications for orifice type and arrangement are set forth in description of the embodiment of FIG. 1. Briefly, orifices 16 are closely spaced with center-to-center spacings of approximately 0.017 inches and are spaced 0.5 inches from the support members. Orifice diameters of 0.005 inches and densities of 60 per manifold inch eject columnar fluid jets which form a uniform fluid curtain.

Figure 20:
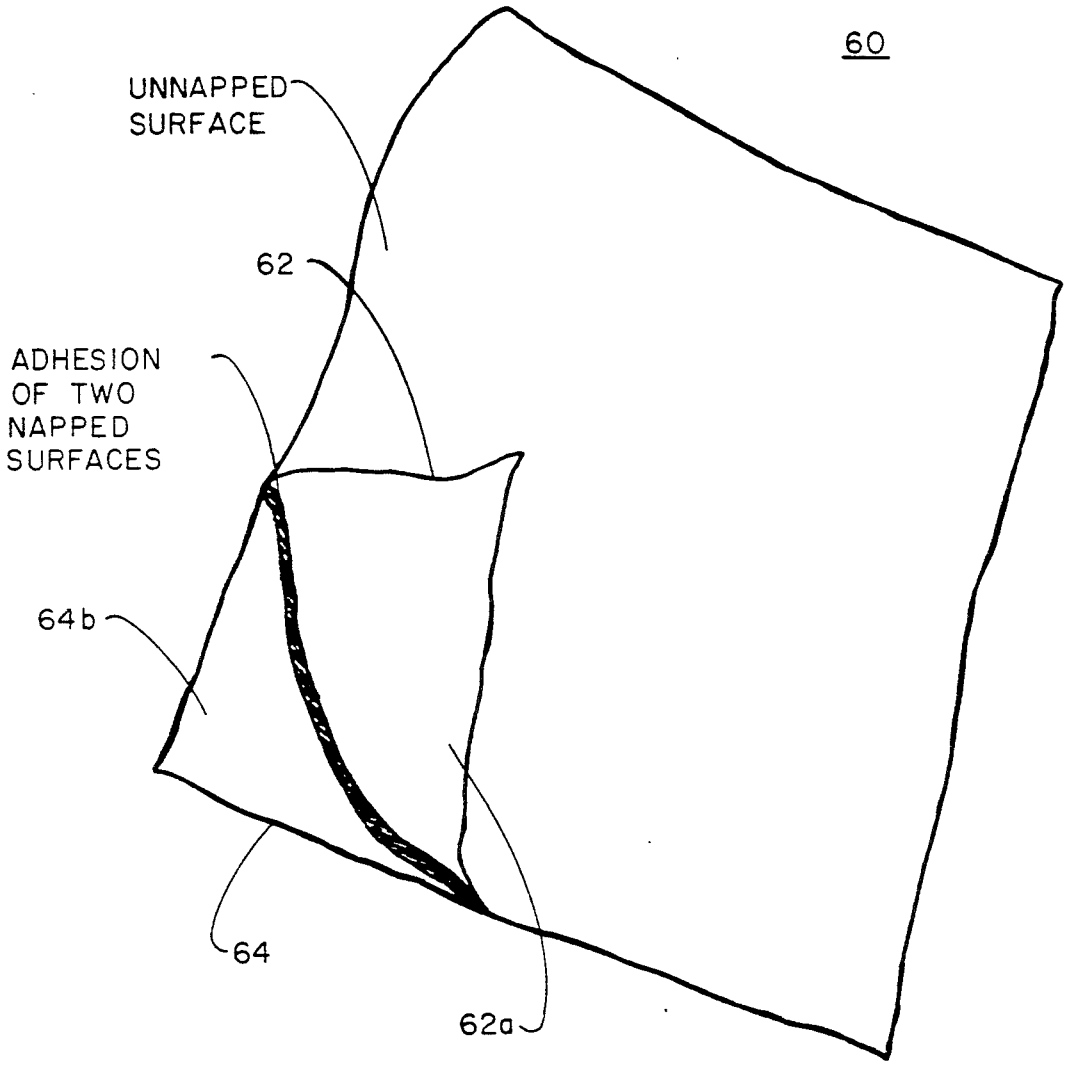
FIG. 20 illustrates a composite fabric including napped fabric components which are bonded into an integral structure employing the hydroenhancing process of the invention.

The following Examples are representative of the results obtained on the process line illustrated in FIG. 20.

EXAMPLE XX

A plain woven 100% polyester fabric comprised of friction spun yarns having the following specifications was processed in accordance with the invention: count of $16\times10$ yarns/in$^2$, weight of 8 ounces/yd$^2$, an abrasion resistance of 50 cycles (measured by 500 grams of a CS17 abrasion test wheel) and an air permeability of 465 ft$^3$/ft$^2$/min.

The fabric was processed on a test line to simulate a speed of 300 ft/min. on process apparatus including four drums 42 and eighteen nozzles 16 at a pressure of approximately 1500 psi. Energy output to fabric at these process parameters was approximately 0.46 hp-hr/lb.

Table XIX sets forth control and processed characteristics of the fabric.

TABLE XIX

| 100% Polyester Friction Spun Fabric | | |
|---|---|---|
| Fabric Characteristic | Control | Processed |
| Count (yarns/in.$^2$) | 16 × 10 | 17 × 10 |
| Weight (ounces/yd.$^2$) | 8 | 8.2 |
| Abrasion resistance (cycles) | 50 | 85 |
| Air permeability (ft$^3$ft$^2$/min.) | 465 | 181 |

EXAMPLES XXI AND XXII

The process conditions of Example XX were employed to process a plain woven cotton osnaburg and plain woven polyester ring spun fabrics yielding the results set forth in Tables XX and XXI.

TABLE XX

| Plain Woven Cotton Osnaburg | | |
|---|---|---|
| Fabric Characteristic | Control | Processed |
| Count (yarns/in.$^2$) | 32 × 26 | 32 × 32 |
| Abrasion resistance (cycles) | 140 | 344 |
| Air permeability (ft$^3$ft$^2$/min.) | 710 | 120 |

TABLE XXI

| Plain Woven Poyester Ring Spun Yarn | | |
|---|---|---|
| Fabric Characteristic | Control | Processed |
| Count (yarns/in.$^2$) | 44 × 28 | 48 × 32 |
| Abrasion resistance (cycles) | 100 | 225 |
| Air permeability (ft.$^3$ft$^2$/min.) | 252 | 63 |

Fabrics processed in Examples XX–XXI are characterized by a substantial reduction in air permeability and increase in abrasion resistance. Process energy levels in these Examples were approximately 0.46 hp-hr/lb. It has been discovered that there is a correlation between process energy and enhancement. Increased energy levels yield optimum enhancement effects.

The foregoing Examples illustrate applications of the hydroenhancing process of the invention for upgrading the quality and physical properties of single ply woven and knit fabrics.

Figure 16B:
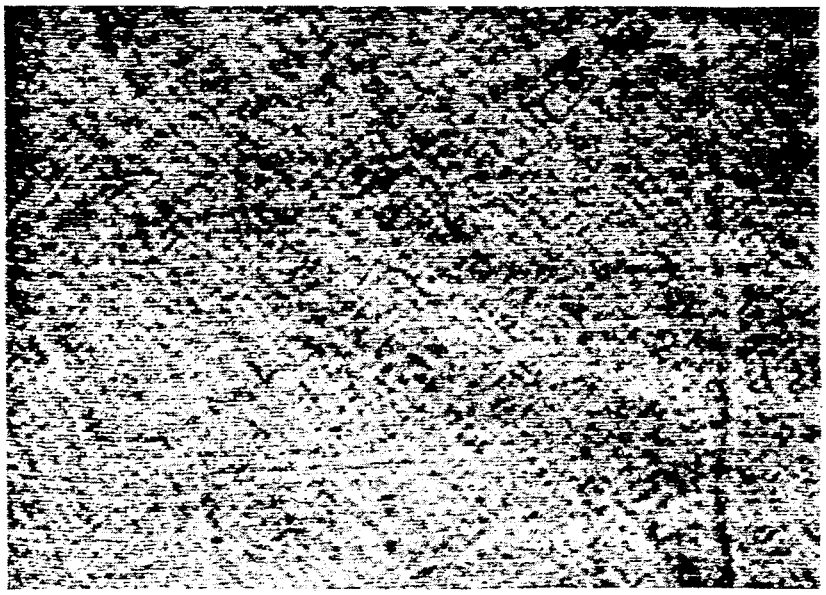
Figure 17A:
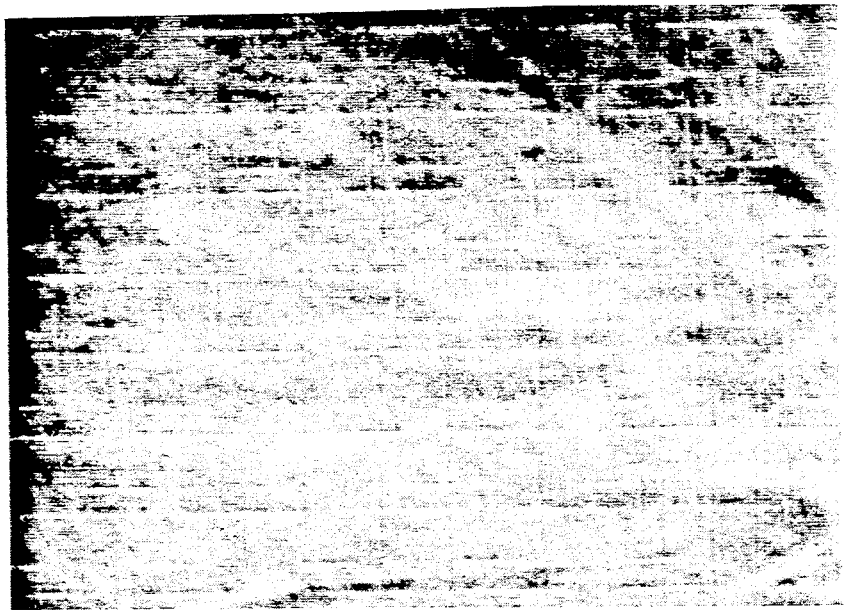
FIGS. 17A and B are photomacrographs at approximately 1X magnification of control and hydroenhanced 100% polyester fabric which includes slub yarns, showing washability surface durability characteristics results obtained in the invention process FIGS. 18A and B are photomacrographs at IX magnification of control and hydroenhanced 80% wool and 20% nylon fabric, showing washability surface durability characteristics results obtained in the invention process.
Figure 17B:
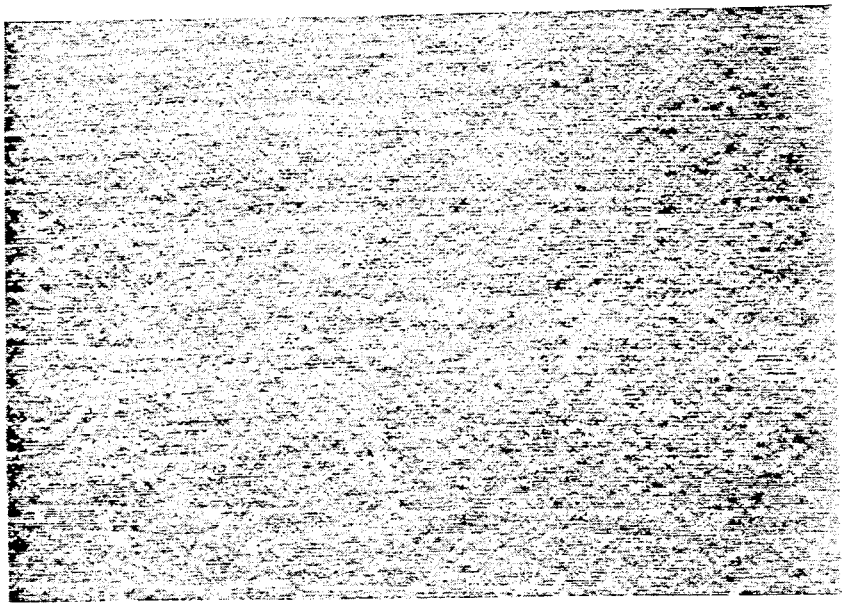
Figure 18A:
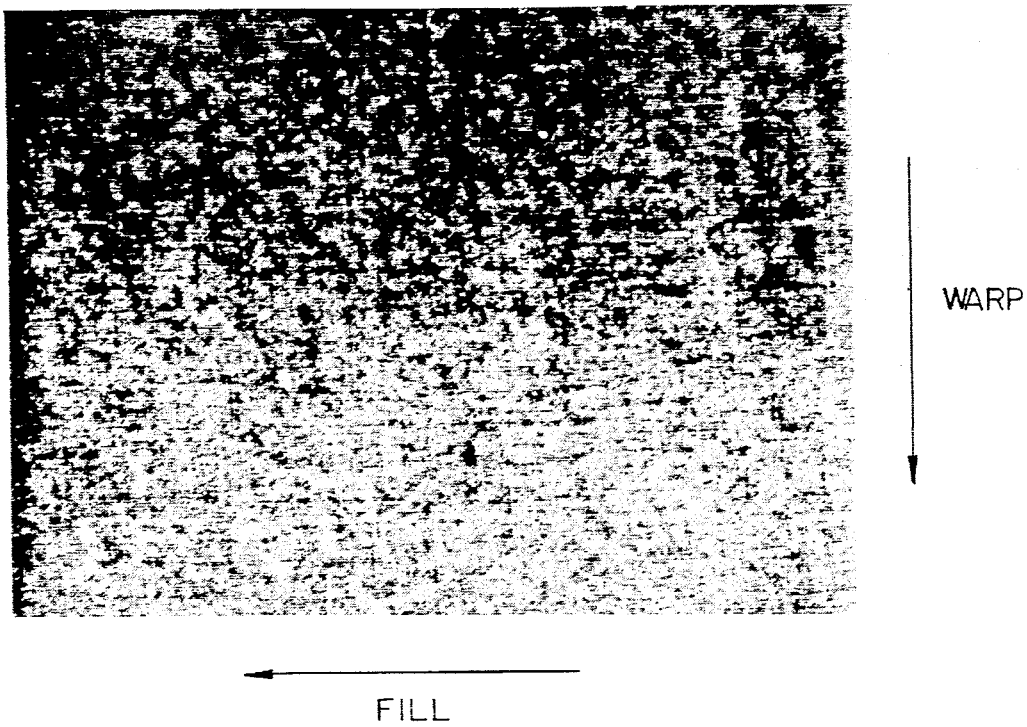
Figure 18B:
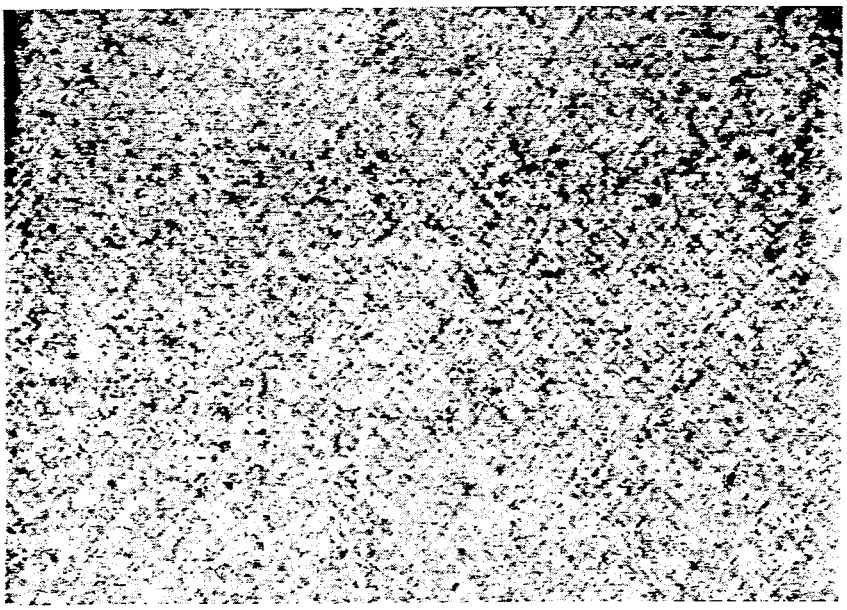

In an alternative application of the hydroenhancing process of the invention, fabric strata are hydrobonded into integral composite fabric. FIG. 20 illustrates a composite flannel fabric 60 including fabric layers 62, 64. Hydrobonding of the layers is effected by first napping opposing surfaces 62*a*, 64*a* of each of the layers to raise surface fibers. The opposing surfaces 62*a*, 44*a* are then arranged in overlying relation and processed on the production line of the invention. See FIGS. 1 and 16. Enhancement of the layers 62, 64 effects entanglement of fibers in the napped surfaces and bonding of the layers to form a integral composite fabric 60. Exterior surfaces 62*b*, 64*b* are also enhanced in the process yielding improvements in cover and quality in the composite fabric.

Napped surfaces 62*a*, 62*b* are provided by use of conventional mechanical napping apparatus. Such apparatus include cylinders covered with metal points or teasel burrs which abrade fabric surfaces.

Advantageously, composite fabric 60 is manufactured without requirement of conventional laminating adhesives. As a result, the composite fabric breaths and has improved tactile characteristics than obtained in prior art laminated composites. It will be recognized that such composite fabrics have diverse applications in fields such as apparel and footwear.

Advantageous results may also be obtained by hydroenhancing a single strata napped fabric. Entanglement of raised fibers in a napped fabric surface obtained in the invention process yield a superior fabric finish.

Figure 21A:
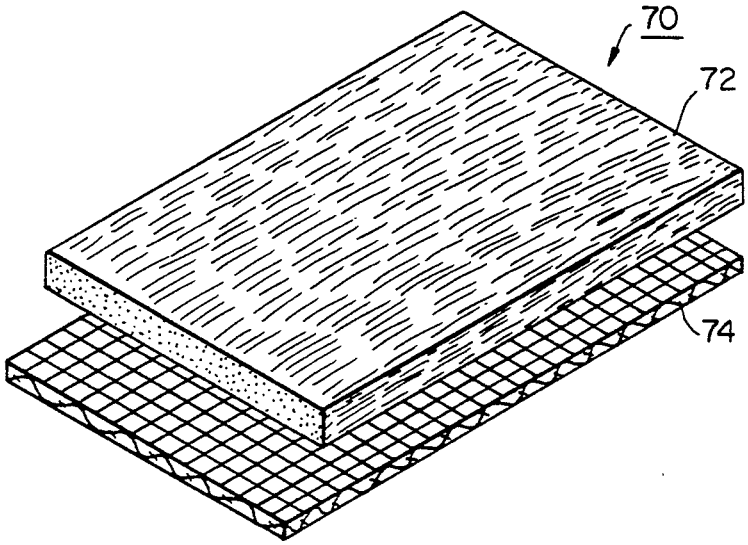
FIG. 21A and B, respectively, are enlarged schematic illustrations, of a nonwoven-textile fabric composite before and subsequent to enhancement and lamination in accordance with the invention process.
Figure 21B:
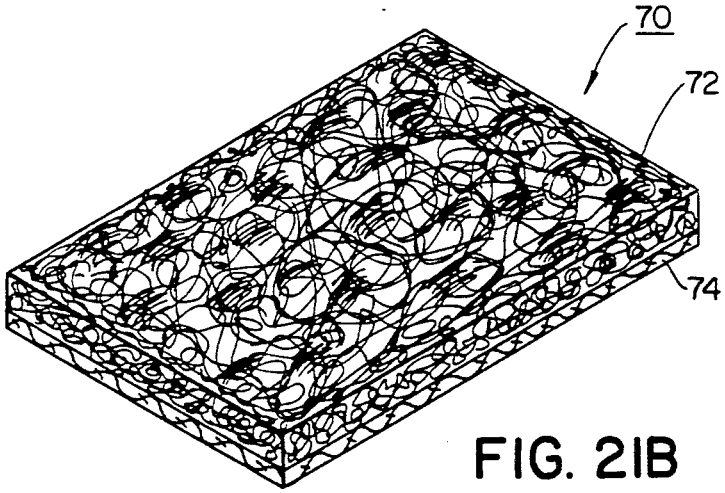

FIGS. 21A and B illustrate a composite nonwoven-woven composite fabric in accordance with a further embodiment of the invention. The fabric composite 70 includes a carded nonwoven and woven layers 72, 74 which are arranged in opposing relation and hydrobonded employing enhancement processing. Hydrobonding of the layers and entanglement of the carded nonwoven layer 72 is effected in a one step fluid treatment process. Enhancement of the bonded composite yields a fabric having improved cover and finish. Such nonwoven-woven composite materials have application, among others, for use as interliner materials in textile products.

In another embodiment of the invention, woven or knit fabrics are provided which comprise wrap spun yarns having a fibrous sliver core and water soluble outer sheath components. Enhancement processing effects wash-out of the soluble sheath and entanglement of sliver core fibrous material to yield a stabilized fabric. Wrap spun yarns impart structural integrity to the fabric useful to facilitate weaving of yarns into a stable material for enhancement processing. Enhancement of the fabric and wash-out of the wrap yields a delicate fabric of superior structural integrity. In a preferred application the fabric yarns include a cotton fiber sliver core having a PVA filament wrap, and both top and bottom surfaces of the fabric are subjected to hydraulic enhancement.

Optimum enhancement (in single and multi-ply fabrics) is a function of energy. Preferred results are obtained at energy levels of approximately 0.5 hp-hr/lb. Energy requirements will of course vary for different fabrics as will process conditions required to achieve optimum energy levels. In general, process speeds, nozzle configuration and spacing may be varied to obtain preferred process energy levels.

Enhanced fabrics of the invention are preferably fabricated of yarns including fibers having deniers and lengths, respectively, in the ranges of 0.3 to 10.0 and 0.5 to 6.0 inches, and yarn counts of 0.5 s to 80 s. Optimum enhancement is obtained in fabrics having fiber deniers in the range of 0.5 to 6, staple fibers of 0.5 to 6.0 inches, and yarn counts in the range of 0.5 s to 50 s. Preferred yarn spinning systems employed in the invention fabrics include cotton spun, wrap spun and wool spun. Experimentation indicates that preferred enhancement results are obtained in fabrics including low denier, short lengths fibers, and loosely twisted yarns.

The invention advances the art by recognizing that superior fabric enhancement can be obtained under controlled process conditions and energy levels. Heretofore, the art has not recognized the advantages and the extent to which hydroenhancement can be employed to upgrade fabric quality. It is submitted that the results achieved in the invention reflect a substantial and surprising contribution to the art.

Numerous modifications are possible in light of the above disclosure. For example, although the preferred process and apparatus employ fluid pervious support members, non-porous support members are within the scope of the invention. Similarly, FIGS. 1 and 20 respectively illustrate two and four stage enhancement process lines. System configurations which include one or more modules having flat, drum or other support member configuration may be employed in the invention.

It will be recognized that the process of the invention has wide application for the production of a diversity of enhanced fabrics. Thus, the Examples are not intended to limit the invention.

Finally, although the disclosed enhancement process employs columnar jet orifices to provide a fluid curtain, other apparatus may be employed for this purpose. Attention is directed to the U.S. Pat. No. 4,995,151 to Siegel et al., entitled "Apparatus and Method For Hydropatterning Fabric", dated Feb. 26, 1991, assigned to International Paper Company, assignee of the present case, which discloses a divergent jet fluid entangling apparatus for use in hydropatterning woven and nonwoven textile fabrics.

Therefore, although the invention has been described with reference to certain preferred embodiments, it will be appreciated that other hydroentangling apparatus and processes may be devised, which are nevertheless within the scope and spirit of the invention as defined in the claims appended hereto.

We claim:

1. An enhanced woven or knit textile fabric which comprises: spun and/or spun filament yarns which intersect at cross-over points to define interstitial open areas and a fabric matrix, said yarns being treated with high pressure fluid energy to effect entanglement thereof in said interstitial open areas, wherein said fluid treatment effects stabilization of said fabric matrix, such that the enhanced woven or knit textile fabric exhibits improved shrink resistance, surface durability, and material absorption and adsorption characteristics.

2. An enhanced woven or knit textile fabric according to claim 1, wherein the fabric includes wool fibers, and the stabilization provides a fabric which is shrink resistant and washable.

3. An enhanced woven or knit textile fabric according to claim 2, wherein the fabric further comprises a second textile fiber.

4. An enhanced woven or knit textile fabric according to claim 3, wherein said textile fiber is polyester.

5. An enhanced woven or knit textile fabric according to claim 1, wherein said fabric includes polyester, and said fluid treatment imparts flame resistance to the fabric.

6. An enhanced woven or knit textile fabric according to claim 1, wherein the fabric includes a napped surface finish having raised surface fibers, said napped finish being subjected to said fluid treatment said fluid treatment entangling said raised fibers and providing a fabric having improved structural integrity and a high loft finish.

7. An enhanced woven or knit textile fabric according to claim 1, wherein the fabric includes wrap spun yarn, said yarn having a sliver core of a first fibrous component, and an outer sheath wrap of a water soluble yarn, said wrap yarn imparting structural integrity to the fabric for textile weaving or knit fabrication, said fluid treatment effecting wash-out of said soluble sheath to provide a stabilized fabric of said first fibrous component having structural integrity.

8. An enhanced woven or knit textile fabric according to claim 7, wherein said sliver core includes cotton fibers, and said outer sheath wrap includes filament fibers selected from the group consisting of polyester and nylon.

9. An enhanced woven or knit textile fabric according to claim 1, wherein said fabric includes wool fibers, a felt and matted finish is imparted to the fabric by hot water treatment, and said fluid entanglement treatment effects interlocking and stabilization of said wool fibers.

10. An enhanced woven or knit textile fabric according to claim 9, wherein said fabric further comprises a second textile fiber.

11. An enhanced woven or knit textile and nonwoven fabric composite comprising: a fabric layer which includes spun and/or spun filament yarns in a structured pattern of yarns which intersect at cross-over points to define interstitial open areas, and a nonwoven layer which includes staple fibers, said fabric and nonwoven layers being arranged in opposing and congruent relation and bonded into an integral composite by treatment with high-pressure fluid energy, wherein said spun and/or spun filament yarns are entangled within said interstitial open areas and said spun and/or spun filament yarns are also entangled with said staple fibers.

12. An enhanced composite fabric according to claim 11, wherein said nonwoven layer comprises a carded web of staple fibers.

13. A method for hydrobonding woven or knit fabric and nonwoven material layers to form a composite textile fabric, the fabric layer including spun and/or spun filament yarns in a structured pattern which interest at crossover points to define interstitial open areas, the nonwoven layer including staple fibers, the method comprising the steps of:

arranging said fabric and nonwoven layers in opposing and overlying layered relation, supporting the layered fabric on a support member, and traversing one side of said layered fabric with a first continuous curtain of fluid for sufficient duration to entangle said spun and/or spun filament yarns in said interstitial open areas and also entangle said staple fibers and spun and/or spun filament yarns, said curtain of fluid impacting the fabric with an energy in the range 0.1 and 2.0 hp-hr/lb.

14. The method of claim 13, wherein said fluid curtain is provided by columnar fluid jet orifices having a diameter of approximately 0.005 inches and center-to-center spacing of approximately 0.017 inches, said fluid curtain impinging the fabric with fluids at a pressure of approximately 1500 psi.

15. The method of claim 14, wherein said support member includes a pattern of closely spaced fluid pervious open areas aligned in a first direction to effect fluid passage through said support member.

16. The method of claim 14, comprising the further steps of:

supporting said layered fabric on a second support member, and traversing the other side of said layered fabric in a second entanglement stage with a second continuous fluid curtain to effect a uniform composite fabric bond and finish, said second entanglement stage impacting the layered fabric with an energy in the range 0.1 and 2.0 hp-hr/lb.

17. The method of claim 16, wherein:

said first and second fluid curtains are provided by columnar fluid jets having a diameter of approximately 0.005 inches and center-to-center spacing of approximately 0.017 inches, said fluid jets impinging the fabric with fluids at pressure of approximately 1500 psi, said first and second support members each include a pattern of closely spaced fluid pervious open areas, respectively aligned in first and second directions, said open areas being dimensioned to effect fluid passage through said support members without imparting a patterned effect to the fabric.

18. A method for enhancing and finishing textile fabrics including spun wool yarns in a structured woven or knit pattern including yarns which intersect at cross-over points, the method comprising the steps of:

felting the fabric by application of hot water treatments to form a matted and integrated fabric finish, supporting the fabric on a first support member, and traversing a first side of said fabric with a first continuous curtain of fluid for sufficient duration to effect entanglement of said yarns at the cross-over points, thereby enhancing fabric cover and quality, said curtain of fluid impacting the fabric with an energy in the range 0.1 and 2.0 hp-hr/lb.

19. The method of claim 18, wherein said fluid curtain comprises hot water.

20. The method of claim 18, wherein said fluid curtain is provided by columnar fluid jet orifices having a diameter of approximately 0.005 inches, center-to-center spacing of approximate 0.017 inches, and spacing from said first support member of approximately 0.5 inches, said fluid jets impinging the fabric with fluids at a pressure of approximately 1500 psi.

21. The method of claim 20, wherein said support member includes a pattern of closely spaced fluid pervious open areas aligned in a first direction to effect fluid passage through said support member.

22. The method of claim 19, comprising the further steps of:

supporting said enhanced fabric on a second support member, and traversing a second side of said enhanced fabric in a second enhancement stage with a second continuous fluid curtain for sufficient duration to further enhance fabric cover and provide a uniform fabric finish, said second enhancement stage impacting the fabric with an energy in the range 0.1 and 2.0 hp-hr/lb.

23. A method for enhancing and finishing textile fabrics including wrap spun yarns in a structured woven or knit pattern which intersect at cross-over points, the fabric including a sliver core of a first fibrous component, and an outer sheath wrap of a water soluble yarn, the method comprising the steps of:

supporting the fabric on a first support member, and traversing a first side of said fabric with a first continuous curtain of fluid for sufficient duration to effect wash-out of the soluble wrap and entanglement of said yarns at the cross-over points, thereby providing a stabilized core material fabric having integrity and enhanced finish, said curtain of fluid impacting the fabric with an energy in the range 0.1 and 2.0 hp-hr/lb.

24. The method of claim 23, wherein said fluid curtain is provided by columnar fluid jet orifices having a diameter of approximately 0.005 inches, center-to-center spacing of approximately 0.17 inches, and spacing from said first support member of approximately 0.5 inches, said fluid jets impinging the fabric with fluids at pressure of approximately 1500 psi.

25. The method of claim 24, wherein said support member includes a pattern of closely spaced fluid pervious open areas aligned in a first direction to effect fluid passage through said support member.

26. The method of claim 25, comprising the further steps of:

supporting said enhanced fabric on a second support member, and traversing a second side of said enhanced fabric in a second enhancement stage with a second continuous fluid curtain for sufficient duration to further enhance fabric cover and provide a uniform fabric finish, said second enhancement stage impacting the fabric with an energy in the range 0.1 and 2.0 hp-hr/lb.

* * * * *